US011673249B2

(12) United States Patent
Reitzig

(10) Patent No.: US 11,673,249 B2
(45) Date of Patent: Jun. 13, 2023

(54) HYDRAULIC TOOL FOR A PULLING AND/OR PRESSING DEVICE

(71) Applicant: WS Wieländer + Schill Professionelle Karosserie-Spezialwerkzeuge GmbH & Co. KG, Tuningen (DE)

(72) Inventor: Klaus Reitzig, Schalksmühle (DE)

(73) Assignee: WS Wieländer + Schill Professionelle Karosserie-Spezialwerkzeuge GmbH & Co. KG, Tuningen (DE)

( * ) Notice: Subject to any disclaimer, the term of this patent is extended or adjusted under 35 U.S.C. 154(b) by 513 days.

(21) Appl. No.: 16/955,831

(22) PCT Filed: Dec. 20, 2018

(86) PCT No.: PCT/EP2018/086404
§ 371 (c)(1),
(2) Date: Jun. 19, 2020

(87) PCT Pub. No.: WO2019/122243
PCT Pub. Date: Jun. 27, 2019

(65) Prior Publication Data

US 2020/0316765 A1 Oct. 8, 2020

(30) Foreign Application Priority Data

Dec. 21, 2017 (DE) ..... 10 2017 130 840.7

(51) Int. Cl.
*B25F 5/00* (2006.01)
*B21J 15/20* (2006.01)
(Continued)

(52) U.S. Cl.
CPC ..... *B25F 5/005* (2013.01); *B21J 15/20* (2013.01); *B25B 27/026* (2013.01); *B25F 5/00* (2013.01);
(Continued)

(58) Field of Classification Search
CPC ... B25B 23/0078; B25B 23/14; B25B 23/147; B25B 27/00; B25B 27/02; B25B 27/10;
(Continued)

(56) References Cited

U.S. PATENT DOCUMENTS 1,244,160 A * 10/1917 Anderson ..... F01B 17/00 417/500
4,531,897 A * 7/1985 Orlita ..... F04B 7/06 417/500
(Continued)

FOREIGN PATENT DOCUMENTS

DE 20017118 U1 3/2001
DE 202009015515 U1 4/2011
(Continued)

*Primary Examiner* — Scott A Smith
(74) *Attorney, Agent, or Firm* — Smartpat PLC

(57) ABSTRACT

Hydraulic tool for driving a pulling and/or pressing device, comprising a drive shaft that can be mounted to a screwdriver, wherein the drive shaft is operable to drive a hydraulic pump that pumps hydraulic fluid into the operating chamber of a hydraulic power piston. The hydraulic tool may in particular be configured as a riveting or punching attachment for a cordless screwdriver.

18 Claims, 19 Drawing Sheets

(51) Int. Cl.

| | |
|---|---|
| ***B25B 27/02*** | (2006.01) |
| *B25B 27/00* | (2006.01) |
| *B25B 27/06* | (2006.01) |
| *B25B 27/10* | (2006.01) |
| *B25F 5/02* | (2006.01) |
| *F15B 15/18* | (2006.01) |

(52) U.S. Cl.
CPC ..... *B25B 27/0014* (2013.01); *B25B 27/064* (2013.01); *B25B 27/10* (2013.01); *B25F 5/026* (2013.01); *F15B 15/18* (2013.01)

(58) Field of Classification Search
CPC ..... B25B 27/14; B25B 27/146; B25B 27/06; B25B 27/064; B25B 27/0014; B25F 5/00; B25F 5/005; B21D 28/00; B21D 28/02; B21D 39/046; B21D 41/026; B23D 29/002; B21J 15/20
USPC ..... 29/243.523; 173/29, 171; 417/500, 415, 417/492
See application file for complete search history.

(56) References Cited

U.S. PATENT DOCUMENTS 5,492,457 A * 2/1996 Lee ..... F04B 9/02 417/415
5,601,421 A * 2/1997 Lee ..... F04B 7/06 91/227
6,218,746 B1 * 4/2001 Gouge, Jr. ..... H02K 7/145 310/47
9,517,363 B1 * 12/2016 Thaw ..... A62B 3/005
2008/0098863 A1 * 5/2008 Kaneyama ..... B23P 19/066 81/468
2010/0154599 A1 * 6/2010 Gareis ..... B25B 23/14 81/54
2012/0284981 A1 11/2012 Bungter et al.
2015/0225905 A1 * 8/2015 Gareis ..... B25F 3/00 81/469
2017/0190035 A1 7/2017 Christoph et al.
2017/0363500 A1 * 12/2017 Boccellato ..... G01N 3/22
2018/0161969 A1 6/2018 Rosani
2019/0162620 A1 * 5/2019 Cattaneo ..... G01L 25/003
2020/0316765 A1 * 10/2020 Reitzig ..... B25F 5/005

FOREIGN PATENT DOCUMENTS

| | | | |
|---|---|---|---|
| DE | 102011111533 | A1 | 2/2013 |
| DE | 102014107752 | A1 | 12/2015 |
| EP | 0963815 | A2 | 12/1999 |
| WO | 2016198973 | A1 | 12/2016 |

* cited by examiner

SECTION E-E

DETAIL D

HYDRAULIC TOOL FOR A PULLING AND/OR PRESSING DEVICE

TECHNICAL FIELD

The disclosure relates to a hydraulic tool for driving a pulling and/or pressing device. More particularly, the disclosure relates to a hydraulic tool which is provided in the form of an attachment for a screwdriver, in particular a cordless screwdriver, and which can be used to operate hydraulic tools for setting rivets, in particular blind rivets, and tools for punching workpieces or for pressing out of or into workpieces.

BACKGROUND

Published patent application DE 10 2011 111 533 A1 (inventor Klaus Reitzig) discloses a pneumatic/hydraulic pressure generator which is designed as a hand-held device and which can in particular be used to operate riveting tools.

Such tools can be connected to an automatically closing hydraulic valve via a quick release coupling.

Since the pressure generator described in this document works on the principle of a pneumatic/hydraulic pump, high pressures can be generated given a small installation space. In this way, a high-performance handheld device could be provided.

A drawback of this prior art pressure generator or of a riveting device comprising this pressure generator is that the tool has a very complex configuration and accordingly is expensive to manufacture.

Furthermore, a compressed air connection is required to operate the tool.

SUMMARY

Given the above, the disclosure is based on the object to provide a tool, in particular a hydraulic tool for driving a pulling and/or pressing device, which is performant and compact in configuration and at the same time can be manufactured particularly easily.

The object of the disclosure is achieved by a hydraulic tool for driving a pulling and/or pressing device, and by a tool comprising a pulling and/or pressing device as claimed.

Preferred embodiments and refinements will be apparent from the subject-matter of the dependent claims, the description and the drawings.

The disclosure relates to a hydraulic tool for driving a pulling and/or pressing device.

More particularly, the disclosure relates to a hydraulic tool which can be used to set rivets, in particular blind rivets, punch rivets, and two-piece rivets. Furthermore, the hydraulic tool may also be used to drive a pressing device, for example for punching or for pressing out or pressing in components.

The hydraulic tool comprises a drive shaft that can be mounted to a screwdriver. More particularly, the hydraulic tool can be mounted to an electric screwdriver, in particular a cordless screwdriver.

The hydraulic tool comprises a hydraulic pump which is driven by the drive shaft and which pumps hydraulic fluid into the operating chamber of a power piston.

Thus, according to a first aspect, the hydraulic tool can be mounted to a commercially available screwdriver, in particular a cordless screwdriver. Such devices which include an electric motor, for example, are available in almost every workshop and are also quite inexpensive.

According to a preferred embodiment, the drive shaft which is connectable to the screwdriver drives a pump piston so as to reciprocate and pump hydraulic fluid into the operating chamber of a hydraulic power piston.

Thus, the tool comprises a hydraulic pump piston, also known as a plunger, which forms part of the hydraulic pump that pumps hydraulic fluid into the working chamber of the power piston by a reciprocating movement of the pump piston.

The power piston has a larger surface area on which pressure is applied than the pump piston. More particularly, the power piston's surface area on which hydraulic fluid can be applied is at least twenty, preferably fifty, preferably up to 100 times as large as that of the pump piston (based on the piston surface area of at least one face of the power piston).

With such a high hydraulic transmission ratio, high pressures and hence correspondingly high pulling and pressure forces can be generated in this way in the operating chamber of the power piston, even with a comparatively small electric tool.

For example, with a torque of 16 Nm of the screwdriver, a pressure of more than 500 bar can be achieved in the operating chamber of the power piston. The power cylinder is preferably capable of generating pressure and/or pulling forces of more than 10,000 N, most preferably of more than 50,000 N.

Furthermore, the hydraulic tool of the invention can be assembled from relatively few components, so that a compact design as a hand-held device can be achieved.

In a preferred embodiment, the power piston is connected to a coupling for a setting or pressing tool attachment.

Thus, the hydraulic tool is of modular configuration such that a tool for different tasks can be provided by coupling different attachments to the power piston, for example a blind riveting tool, a tool for setting two-piece rivets, and a punching tool.

In a preferred embodiment, a cam can be used to move the pump piston in reciprocating manner. More particularly, it is suggested that a cam shaft rotates within two ball bearings or needle roller bearings.

Two further ball bearings or a needle roller bearing are mounted on the cam, positively fitted to the pump piston. In this way, a reciprocating drive for the pump piston can be provided in a confined space, which has a simple structure and provides for a long service life.

It will be understood that in order to provide a hydraulic pump the pump piston pumps the hydraulic fluid into the operating chamber of the power piston through a suction valve and a pressure valve.

The pump piston preferably has a stroke of more than 1 mm and less than 10 mm, preferably from 2 to 7 mm.

In one embodiment, the hydraulic tool comprises a hydraulic fluid accumulator which serves as a buffer volume when the power piston moves. In this way, a self-contained system can be provided in which the hydraulic fluid flowing in or out during the movement of the power piston flows into or out of the buffer volume.

The power piston of the hydraulic tool is preferably designed as a differential piston. A front surface of the piston has a smaller surface area for hydraulic fluid to act upon than the rear surface of the piston, in particular due to a tool holder. Consequently, when the power piston is retracted, more hydraulic fluid will be displaced behind the power piston than flowing in in front of the power piston for the retracting. This can be compensated for by the accumulator.

The hydraulic tool can preferably be set to an advance setting position or a retract setting position for the power piston, using an operator control. In the advance setting position for the power piston, the latter will preferably move forward alone due to the pressure in the hydraulic fluid accumulator, whereas in the retract setting position, the power piston will remain in its position when the cordless screwdriver is not operated. This allows to slowly approach the workpiece when riveting or punching.

The hydraulic tool is preferably coupled to the setting or pressing tool attachment described above in a purely mechanical manner, allowing to eliminate the provision of a hydraulic valve.

The hydraulic fluid accumulator is preferably arranged behind the power piston and laterally offset from the drive shaft.

The hydraulic fluid accumulator is in particular configured so as to be arranged above the screwdriver housing when coupled to a screwdriver. This provides for a compact design.

More particularly, it is suggested that the housing of the hydraulic tool is divided into three essential sections.

A first section of the housing encompasses the operating chamber with the power piston and is preferably arranged in front of the drive shaft ("in front of", "behind", "above" and "below" in the sense of the invention refers to the position in the installed state as seen from a cordless screwdriver that stands on its foot).

The coupled tool attachment is preferably arranged coaxially to the drive shaft of the screwdriver, so that the ergonomic shape of the screwdriver and its operating button may optionally still be used.

A second housing section including the hydraulic fluid accumulator extends laterally offset from the drive shaft and is therefore arranged next to or above the screwdriver housing in the coupled state thereof.

An intermediate housing section is arranged therebetween, which includes at least the pump piston which forms part of the hydraulic pump.

The pump piston is preferably arranged transversely, in particular perpendicular to the drive shaft and/or to the power piston. In this way, the cam may be coupled collinearly to the drive shaft and can drive the pump piston. This also facilitates the provision of a tool with compact design.

In a preferred embodiment, the hydraulic tool comprises an operator control the actuation state of which defines whether hydraulic fluid is fed into an operating chamber of the power piston either in front of or behind the power piston.

Thus, the operator control is configured for setting the hydraulic tool into two operating states, either for pressing or for pulling.

For pressing, the hydraulic pump pumps hydraulic fluid into the operating chamber behind the power piston, whereas for drawing, the fluid is pumped into the operating chamber in front of the power piston.

For this purpose, the operator control is preferably coupled to a hydraulic control valve.

Preferably, this will be a spring-biased resetting 5/2-way valve, in particular in order to provide the functionality of automatically moving into a predetermined end position.

According to one embodiment, the operator control is configured so that has to be actuated permanently in order to advance the power piston.

The hydraulic tool is in particular configured such that in the initial position of the operator control, pressure is applied to the power piston from the side of the piston rod, so that the power piston is retracted.

The drive shaft of the screwdriver drives the hydraulic pump and the power piston is pulled back with such a strong force that a reshaping process can be effected, for example a blind rivet setting process.

On the other hand, in order to use the hydraulic pump to advance the power piston, for example for punching or for processing two-piece rivets, the user has to permanently actuate the actuation means.

This ensures two-hand operation for pressing, which increases the safety of the hydraulic tool.

As suggested according to one embodiment, the control valve may comprise a rod which extends transversely, in particular perpendicular to the power piston, which serves to open and close passages extending along the rod. The control valve may in particular be switched through tappet actuation.

The hydraulic fluid accumulator is preferably connected upstream of the hydraulic pump.

The accumulator preferably buffers a quantity of hydraulic fluid which at least equals and preferably amounts to at least twice the displacement of the power cylinder.

For example, the hydraulic fluid accumulator may comprise a spring-biased piston. This piston permanently applies a pressure to the hydraulic fluid in the accumulator. Alternatively conceivable is a pressurized gas accumulator in which a gasket or a piston is biased by pressurized gas.

In the non-operated state, the pressure in the hydraulic fluid accumulator is preferably 5 to 30, most preferably 8 to 15 bar.

When the control valve which is in particular in the form of a 5/2-way valve is actuated without operating the screwdriver, the power piston will move into the front end position solely by virtue of this pressure. This occurs in particular because the power piston is configured as a differential piston.

Preferably this will be a front end position. For example, the power piston will always move forward when the directional control valve is actuated without operating the screwdriver, so that, for example when setting a rivet, the setting punch can be slowly approached to the workpiece, and without power consumption.

When the directional control valve is returned to its initial position and the screwdriver is operated, the power piston will be retracted and the hydraulic fluid accumulator is recharged, since the hydraulic fluid located behind the power piston will be returned.

In one embodiment, the hydraulic tool comprises a pressure control valve which preferably is in the form of a full lift safety valve and which preferably offers the option of presetting the maximum operating pressure or maximum pressing force.

Once a preset maximum pressure is reached, the valve will open and prevent the preset operating pressure and hence the permissible pressing or pulling force from being exceeded. The overflowing hydraulic fluid will flow back into the hydraulic accumulator.

The hydraulic tool of the invention actually benefits from the fact that cordless screwdrivers usually have an adjustable torque limitation which can advantageously be exploited to limit the force exerted by the power piston.

However, if the user does not enable the torque limitation, the pressure control valve will ensure that only a predetermined maximum pressure is reached in the hydraulic zone and that consequently the maximum torque provided on the drive shaft is also limited.

In one embodiment, the hydraulic tool comprises a torque support which is adapted so as to be supported on the housing of the screwdriver.

The torque support is in particular arranged on the hydraulic fluid accumulator housing.

So, in order to connect the hydraulic tool to the screwdriver, the drive shaft only needs to be clamped in the chuck of the screwdriver.

The torque support serves to support the hydraulic tool on at least one side, preferably on both sides of the housing. It is therefore not necessary for the housing of the hydraulic tool to be coupled to the housing of the screwdriver by further assembly steps such as by screwing.

The counter torque may also be exerted through a handle, as is suggested according to a further embodiment.

More particularly, a tool attachment coupled to the coupling of the hydraulic tool may comprise a handle.

According to one embodiment, the handle can be removed, preferably without tools. In this way it is possible for the tool to be adapted to right- or left-handed operation, for example.

In one embodiment, an elastic coupling is arranged between the drive shaft and the hydraulic pump. The elastic coupling may in particular comprise a component made of elastic material, such as an elastic ring, through which the drive shaft can be connected to the hydraulic pump, in particular to a hydraulic pump that comprises a reciprocating pump piston.

In particular if a reciprocating pump piston is used, the torque transitions that change abruptly due to the pump piston are absorbed by the elastic coupling in a simple way. Thus, the tool runs more smoothly and does not rattle.

The elastic coupling can in particular be integrated in the housing of the hydraulic tool.

In a further embodiment, the hydraulic tool comprises a chuck lock for the screwdriver, in particular for a cordless screwdriver.

The chuck lock is used to lock the chuck of the coupled screwdriver so as to prevent is from loosening due to vibrations.

The chuck lock may in particular comprise a bell coupled with the drive shaft, which can be slidingly fitted around the chuck of the cordless screwdriver and can be coupled to the chuck by means of a clamping element, in particular a clamping collar.

In a further embodiment, the drive shaft comprises a flywheel.

The flywheel also serves to provide for a smoother operation, since the power stroke due to a changing torque caused by the pump piston is absorbed in this way.

The flywheel may in particular be provided in the form of the chuck lock bell mentioned above.

The disclosure furthermore relates to a hydraulic tool for driving a pulling and/or pressing device, in particular a hydraulic tool configured as described above with the exception that it does not necessarily have to be designed as an attachment for a screwdriver.

This embodiment therefore also relates to hydraulic tools in which the drive shaft is driven by a motor, in particular an electric or pneumatic motor that is installed in the housing of the hydraulic tool.

Otherwise, the hydraulic tool may be configured as described above. A drive shaft drives a hydraulic pump which pumps hydraulic fluid into the operating chamber of a power piston. The hydraulic pump preferably comprises a reciprocatable pump piston. The pump piston pumps hydraulic fluid into the operating chamber of a hydraulic power piston. The power piston, in turn, is connected to a coupling for a setting or pressing tool attachment. Furthermore, the hydraulic tool comprises a pressurized hydraulic fluid accumulator which serves as a buffer volume during movement of the power piston which is in the form of a differential piston.

As described above, the hydraulic tool is preferably configured so that the pressurized hydraulic fluid accumulator moves the power piston into an end position when the control valve is set to the advance position and the screwdriver is not operated.

In this way, the tool provides an advance movement which in the non-operated state of the hydraulic pump causes the tool attachment connected to the piston rod of the power piston to approach the workpiece without exerting a force sufficient to perform a reshaping process.

The pump piston is preferably caused to move in a reciprocating manner by a drive shaft through a cam.

The disclosure furthermore relates to a tool comprising a pulling and/or pressing device which can be driven by a screwdriver.

More particularly, the disclosure relates to a hydraulic tool as described above. However, the subject-matter of the invention may also encompass a tool with a pulling or pressing device, in particular a tool for setting rivets, which is not driven hydraulically but on the basis of another principle, for example mechanically by means of a spindle via the screwdriver.

The tool can be coupled to the screwdriver via a drive shaft. The drive shaft which protrudes from a housing of the tool serves to drive the pulling and/or pressing device.

A torque support can be used to couple the tool to a torque limit setting means of the screwdriver such that a torque clutch of the screwdriver opens when a maximum torque is exceeded.

The disclosure thus relates to a tool which in combination with a screwdriver coupled thereto, in particular a cordless screwdriver, uses a torque limit setting means, in particular an adjustment collar of the cordless screwdriver for limiting the force of the pulling and/or pressing device. For this purpose, the housing of the tool is supported on the torque setting means of the cordless screwdriver. When a maximum torque is reached, the tool housing with the pulling or pressing device will rotate away and will open the torque clutch of the cordless screwdriver, so that it no longer drives the pulling and/or pressing device.

This is advantageously achieved by the fact that the tool comprises a tool attachment with the pulling or pressing device, which is rotatably mounted to the tool. The couplings between the tool attachment and the housing are able to rotate relative to each other when a particular torque is applied, for example due to seals such as O-rings that are used. In particular, the tool attachment and the housing of the tool are rotatably connected to one another in such a way that the tool attachment will rotate relative to the housing of the tool once a particular design-dependent frictional torque is reached.

When executing a pulling or pressing operation, the tool housing is held in place due to this coupling (and the torque required to trigger the torque limit setting means of the screwdriver). When the torque between the screwdriver and the housing increases, for example towards the end of a setting operation, the predefined maximum torque will be exceeded and the tool housing with the pulling and/or pressing device can rotate relative to the cordless screwdriver. By such rotation of the tool housing, the torque support which engages around the torque limit setting means of the screwdriver will open the torque clutch and the tool will no longer be driven.

Thus, torque limitation can be implemented in a simple way, and in conjunction with the hydraulic tool described above, the maximum pressure around the hydraulic zone of the hydraulic tool can be limited.

BRIEF DESCRIPTION OF THE DRAWINGS

The subject-matter of the disclosure will be discussed in more detail below with reference to an exemplary embodiment illustrated in the drawings of FIGS. 1 through 28.

FIG. 26 is a sectional view.

FIGS. 27 and 28 are detail views of FIG. 26.

DETAILED DESCRIPTION

Figure 1:
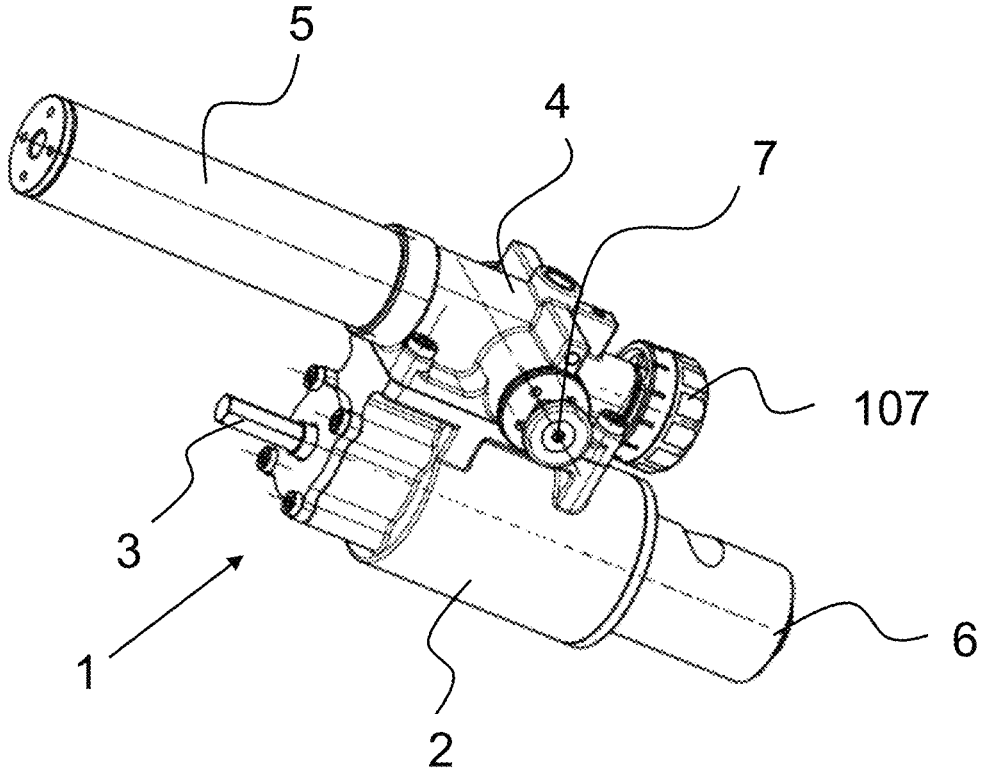
FIG. 1 is a perspective view of a hydraulic tool, this view not showing the torque support nor the coupled screwdriver or tool attachment.

FIG. 1 is a perspective view of a hydraulic tool 1.

Hydraulic tool 1 comprises a housing which can be subdivided into three sections.

Drive piston housing 2 includes the drive piston or power piston and in addition thereto a drive shaft 3 that can be coupled with the chuck of a screwdriver, in particular a cordless screwdriver.

On the side opposite the drive shaft 3, the drive piston housing 2 has a coupling 6 to which a setting tool or pressing tool attachment can be connected.

Laterally, the drive piston housing merges into a hydraulic pump housing 4. The hydraulic pump housing 4 comprises an operator control 7 which can be used to set whether the hydraulic tool 1 pulls or presses.

Furthermore, a pressure control valve is integrated in the hydraulic pump housing in this exemplary embodiment. The control dial 107 coupled to the pressure control valve serves to set the maximum pressure in the operating chamber of the power piston and thus the maximum pulling or pressing force.

An accumulator housing 5 is arranged adjacent to a rear side of the hydraulic pump housing 4.

It has a cylindrical shape and extends backwards laterally offset from the drive shaft 3.

Figure 2:
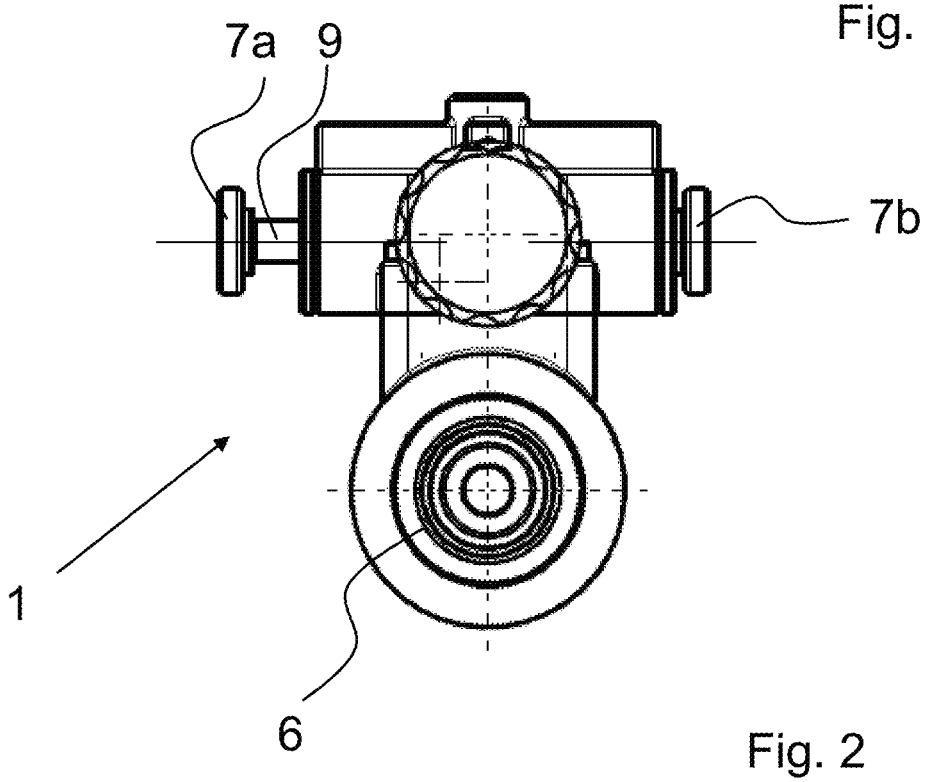
FIG. 2 is a top view on the coupling for mounting the tool attachment.

FIG. 2 is a top view of the end face of the hydraulic tool 1.

The coupling 6 can be seen, to which a setting or pressing tool attachment can be fastened, in particular screwed.

Also, it can be seen that the operator control 7 comprises the two opposite actuation means 7*a* and 7*b*, which defines a tappet actuation for the control valve described below.

Actuating elements 7*a* and 7*b* are connected to one another through a rod 9.

The rod 9 serves to actuate the control valve.

In order to move the power piston forward to perform a pressing operation, the user has to press the actuation means 7*a*. Without operation of the coupled screwdriver, the power piston will then slowly move forward, by virtue of the pre-pressure in the hydraulic accumulator. If the screwdriver is operated at the same time, high pressure will be applied to the power piston and the actual pressing process will be performed. If, on the other hand, the user presses the actuation means 7*b* and thus moves the control valve into the position shown here, the power piston will be hydraulically driven so as to move backwards when the screwdriver is operated.

Figure 3:
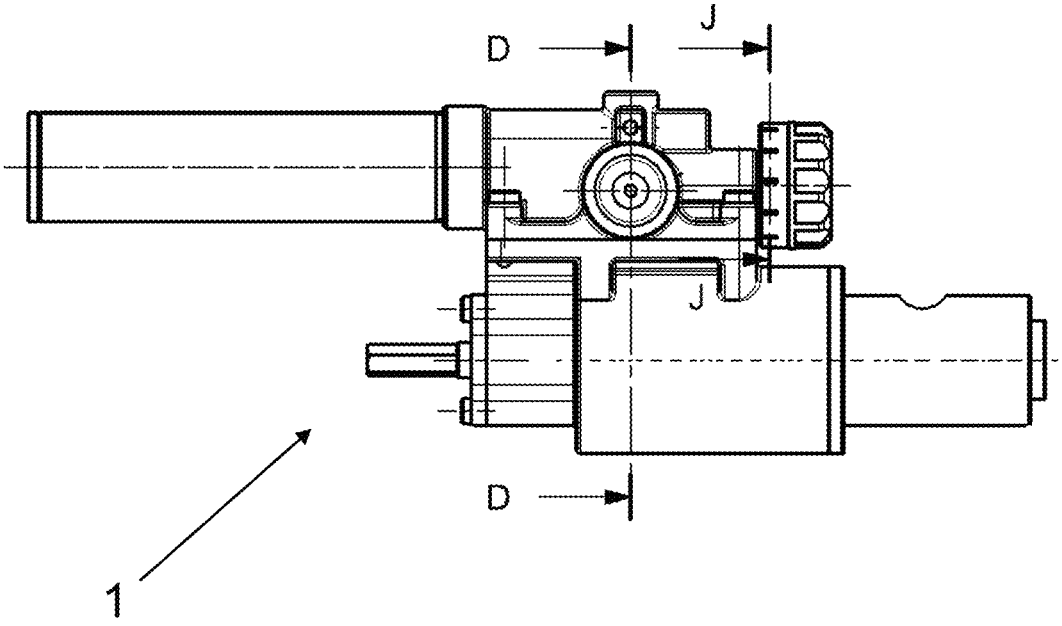
FIG. 3 is a side view and FIG. 4 is a top view of the hydraulic tool.
Figure 4:
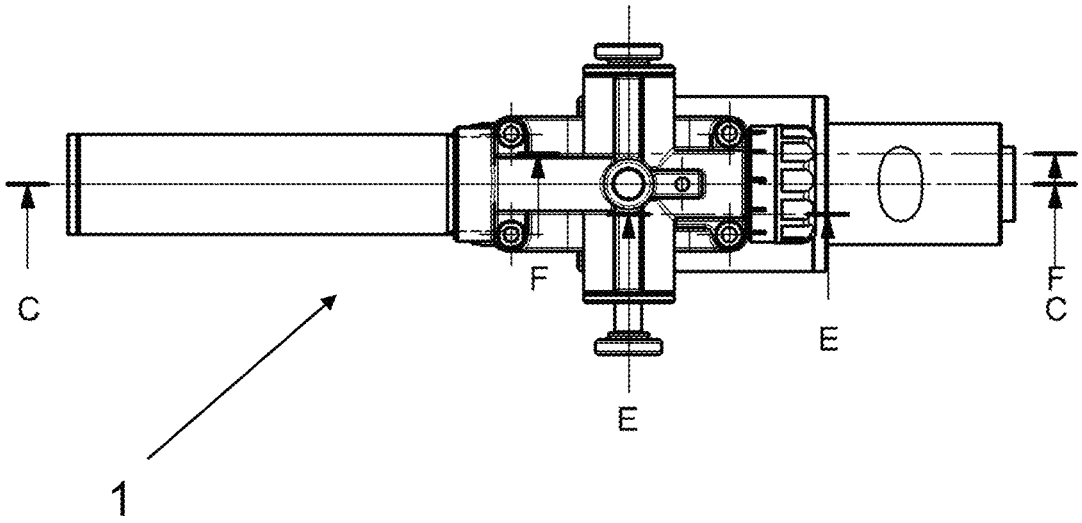

FIG. 3 is a side view of the hydraulic tool 1, and FIG. 4 is a plan view of the top thereof.

Figure 5:
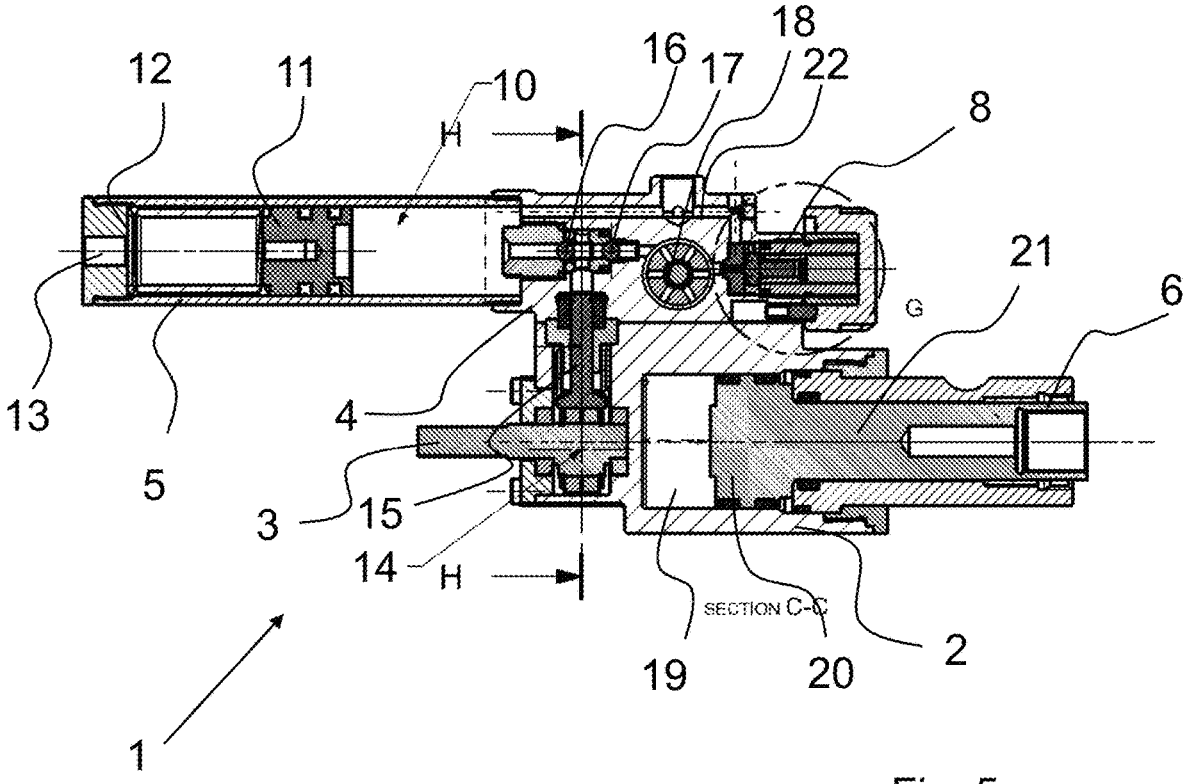
FIG. 5 is a sectional view along the main extension direction of the hydraulic tool.

FIG. 5 is a sectional view taken along line C-C in FIG. 4.

In this view, the hydraulic tool 1 is cut centrally along its main extension direction.

The drive shaft 3 causes the spring-biased pump piston 15 to reciprocate by virtue of a cam drive 14.

The pump piston 15 extends transversely, in particular perpendicular to the drive shaft 3 and extends from the power piston housing 2 into the hydraulic pump housing 4.

Via a suction valve 16 and a pressure valve 17, the reciprocating piston 15 allows hydraulic fluid to be pumped into the operating chamber 19 of the power piston 20.

The control valve 18 which is connected to the actuation means (7 in FIG. 1) serves to set whether the hydraulic fluid shall flow into the operating chamber 19 in front of or behind the power piston 20.

When moving the pump piston 15 in reciprocating manner through the drive shaft 3, the power piston 20 can thus be used to drive both a pulling tool and a pressing tool.

For this purpose, the power piston 20 is connected to the coupling 6 through piston rod 21.

The hydraulic tool 1 furthermore comprises the hydraulic fluid accumulator 10 which serves as a buffer volume.

The accumulator 10 is pressurized so as to be permanently held under pressure.

For this purpose, a piston 11 is provided in this exemplary embodiment, which is biased by a spring 12 in the accumulator housing.

When the piston 11 is displaced, air can flow out of or into the accumulator housing 5 via passage 13.

The pressure thus prevailing in the hydraulic fluid accumulator 10 ensures that in a non-operated state the power piston 20 moves into a front end position, as illustrated here.

Furthermore, the hydraulic tool comprises a pressure control valve 8 which opens as soon as an adjustable discharge-side maximum pressure is reached and allows hydraulic fluid to flow through passage 22 and into the accumulator 10. Thus, the pressure control valve is at the same time effective as a safety valve.

Figure 6:
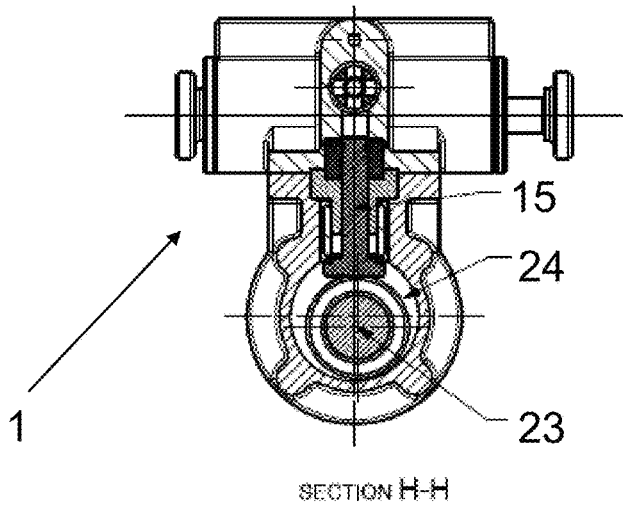
FIG. 6 is a sectional view conceived for explaining in more detail the driving of the pump piston.

FIG. 6 is a sectional view taken along line H-H in FIG. 5.

This sectional view is taken perpendicular to the main extension direction of the hydraulic tool 1.

What can be seen is the area around the reciprocating pump piston 15.

In order to move the pump piston 15 in a reciprocating manner, the drive shaft (3 in FIG. 5) is connected to a cam shaft 23.

Fitted to the cam of the cam shaft 23 is a ball bearing or needle roller bearing 24 on which the pump piston 15 sits. For this purpose, the latter may be biased by a spring (not shown). The cam shaft 23 itself is mounted in two ball bearings in this embodiment.

Regardless of the direction of rotation of the coupled screwdriver, the cam shaft 23 will move when the drive shaft rotates and thus, through ball bearing 24, will cause the pump piston 15 to reciprocate.

Thus, with the suction and pressure valves (16 and 17) shown in FIG. 5, the pump piston 15 forms a hydraulic pump.

Figure 7:
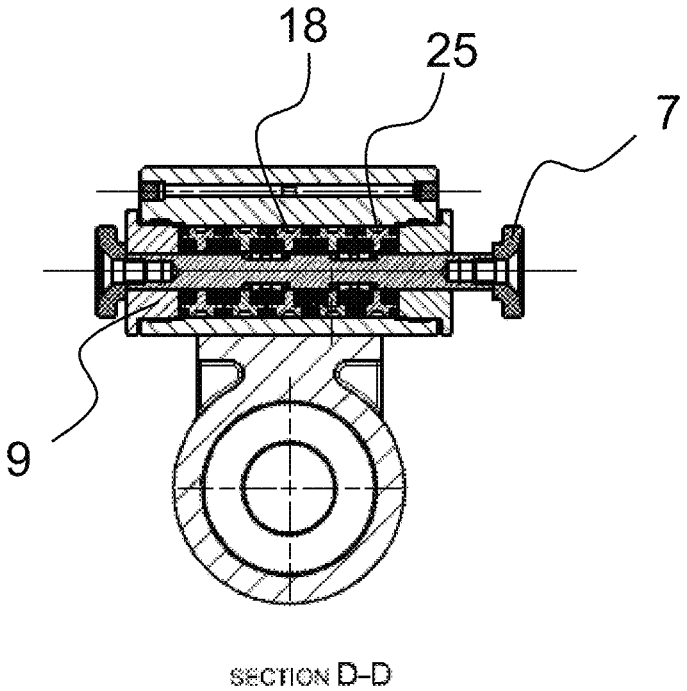
FIG. 7 is a sectional view of an area including the control valve.

FIG. 7 is a sectional view taken along line D-D in FIG. 3.

What is shown here is the area of control valve 18 in a sectional view perpendicular to the main extension direction.

The control valve is actuated through rod 9 which is coupled to the operator control 7.

From an accumulation passage 25 which is under pressure in the operated state of the screwdriver, hydraulic fluid can be pumped into different passages through the control valve 18 which is in the form of a 5/2-way valve.

In one setting position, the control valve 18 is switched such that the power piston will move forward due to the pressure in the buffer volume when the screwdriver is not operated. When the screwdriver is operated, the power piston will be moved forward driven by the hydraulic pump.

In the other setting position of the control valve 18, by contrast, the power piston will be moved backwards by the hydraulic pump when the screwdriver is operated, thereby recharging the hydraulic fluid accumulator 10.

Figure 8:
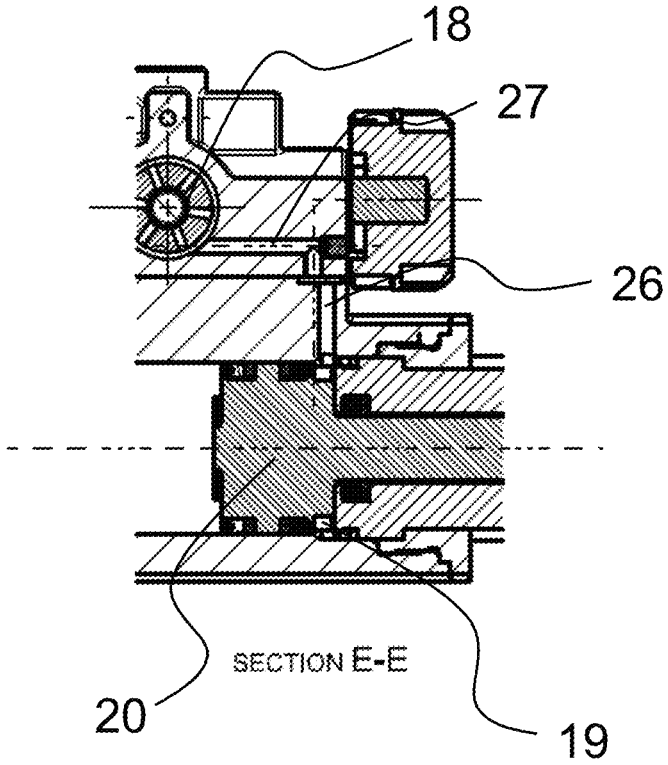
FIGS. 8 and 9 are sectional views intended for explaining the feeding of the hydraulic fluid during pulling and pressing.

In the sectional view of FIG. 8, which shows a section along E-E of FIG. 4, the power piston 20 is in its front end position. If the control valve is set to the advance position for the power piston, the power piston 20 will move into this position due to the pressure prevailing in the hydraulic fluid accumulator.

It can be seen that in order to retract the power piston 20, hydraulic fluid can be pumped via control valve 18 through passages 27 and 26 and into the operating chamber 19 in front of the power piston 20.

In this way, the power piston 20 will be actively retracted by the hydraulic pump and can, for example, drive a blind rivet tool attachment.

Figure 9:
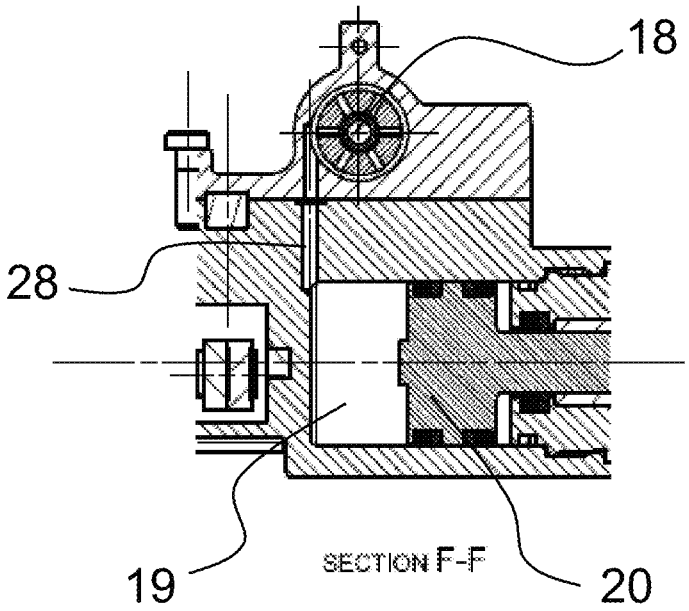

FIG. 9, on the other hand, shows a sectional view along F-F of FIG. 4, which illustrates how the control valve 18 is switched when the power piston 20 is advanced by the hydraulic pump.

Through passage 28, the hydraulic pump pumps hydraulic fluid into the operating chamber 19 behind the power piston 20.

According to one embodiment, the actuation means (7 in FIG. 1) has to be actuated permanently for this purpose, in order to ensure two-hand operation upon pressing.

When the screwdriver is operated, the power piston 20 will be moved forward by the hydraulic pump, for example in order to set a rivet or to punch out a hole.

Figure 10:
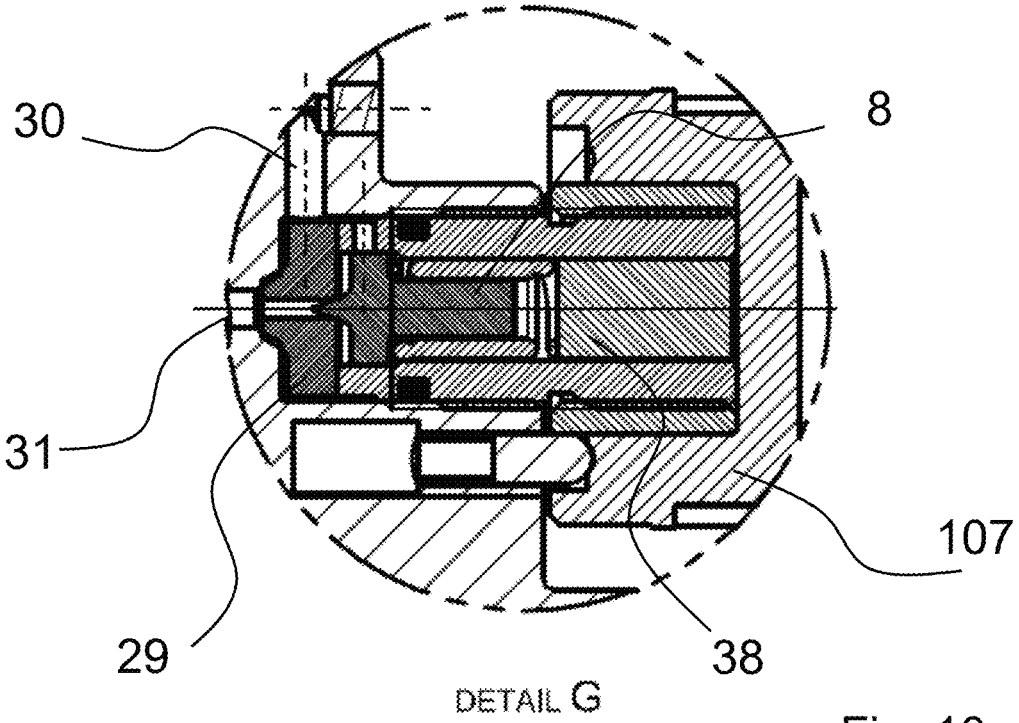
FIG. 10 is a detail view of the pressure control valve.

FIG. 10 is a detail view of the area Gin FIG. 5.

Here, the pressure control valve 8 is shown.

When a maximum pressure is exceeded in the hydraulic zone downstream of the pressure valve (17 in FIG. 5), the pressure control valve 8 will open due to the hydraulic pressure applied to passage 31, by causing the spring-biased valve body 29 to be pushed out.

Hydraulic fluid will then flow back into the accumulator (10 in FIG. 5) via passage 30 (and passage 22 shown in FIG. 5). Thus, the hydraulic pump is virtually short-circuited and the pressure in the operating chamber of the power piston is prevented from rising further.

Pressure control valve 8 is designed as a full lift safety valve which opens suddenly once the valve body 29 with needle-shaped front end is lifted, due to the larger cross-section therebehind. This will interrupt the pressing or drawing process. Only after the screwdriver has been switched off, the valve body 29 will be able to return to its initial position against the pressure of the hydraulic accumulator (10).

Valve body 29 is spring-biased, and the opening pressure can be adjusted using the setting means 38 which is driven by the control dial 107 and changes the spring-bias.

Figure 11:
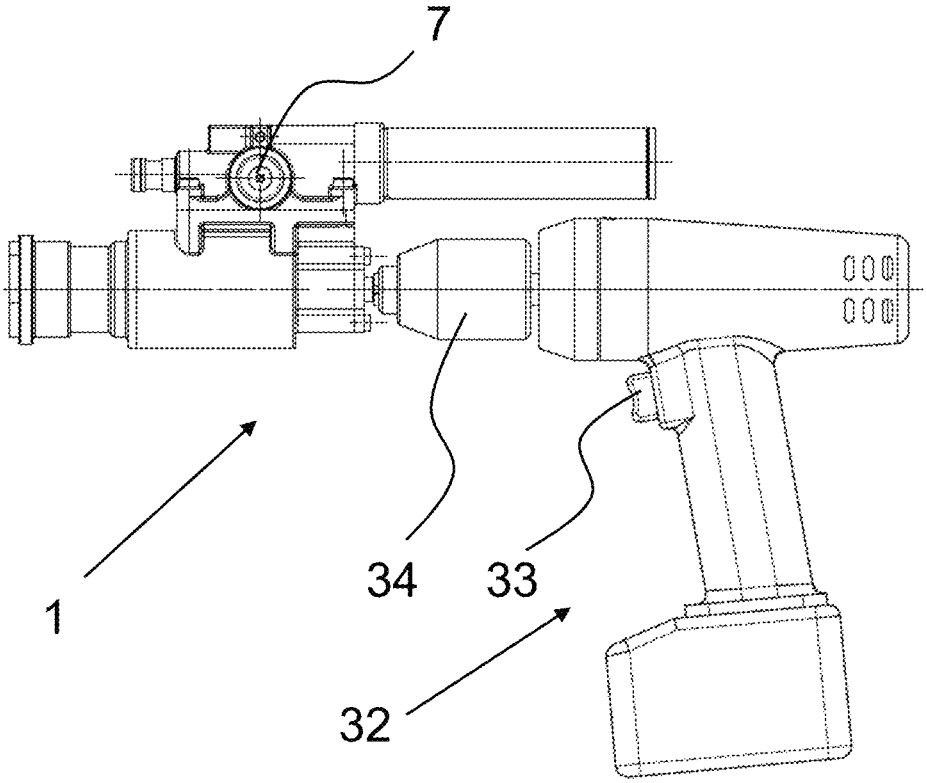
FIG. 11 shows the hydraulic tool coupled to a cordless screwdriver.

FIG. 11 now shows how the hydraulic tool 1 is coupled to a cordless screwdriver 32.

Cordless screwdriver 32 has a handle with an operation button 33.

The drive shaft of the hydraulic tool 1 is clamped in the chuck 34 of the cordless screwdriver.

In this way, a tool combination is provided which the user can grasp by the handle of the cordless screwdriver 32.

In the basic state of the operator control 7, the power piston is completely extended.

For example, if, depending on the embodiment of the hydraulic tool, the user wants to set a rivet or punch out a metal sheet, the user first has to actuate the operator control 7 or bring it into an advance position for the power piston. By pressing the operation button 33 on the cordless screwdriver 32, the power piston is driven forward, together with a setting punch coupled thereto, for example.

Then, depending on the embodiment, the user sets the operator control 7 into the retract position for the power piston.

When the cordless screwdriver is operated, the power piston will then move back and recharge the hydraulic fluid accumulator.

Thus, the device will be ready for the next riveting or pressing process.

When the control valve is actuated into the advance position without operating the cordless screwdriver 32, the power piston will move forward solely by the pressure of the hydraulic fluid accumulator (10). In this way, the setting punch can be slowly approached to the workpiece, for example.

By operating the cordless screwdriver 32, the hydraulic pump is operated and a pressing process is triggered, for example in order to set a rivet.

Figure 12:
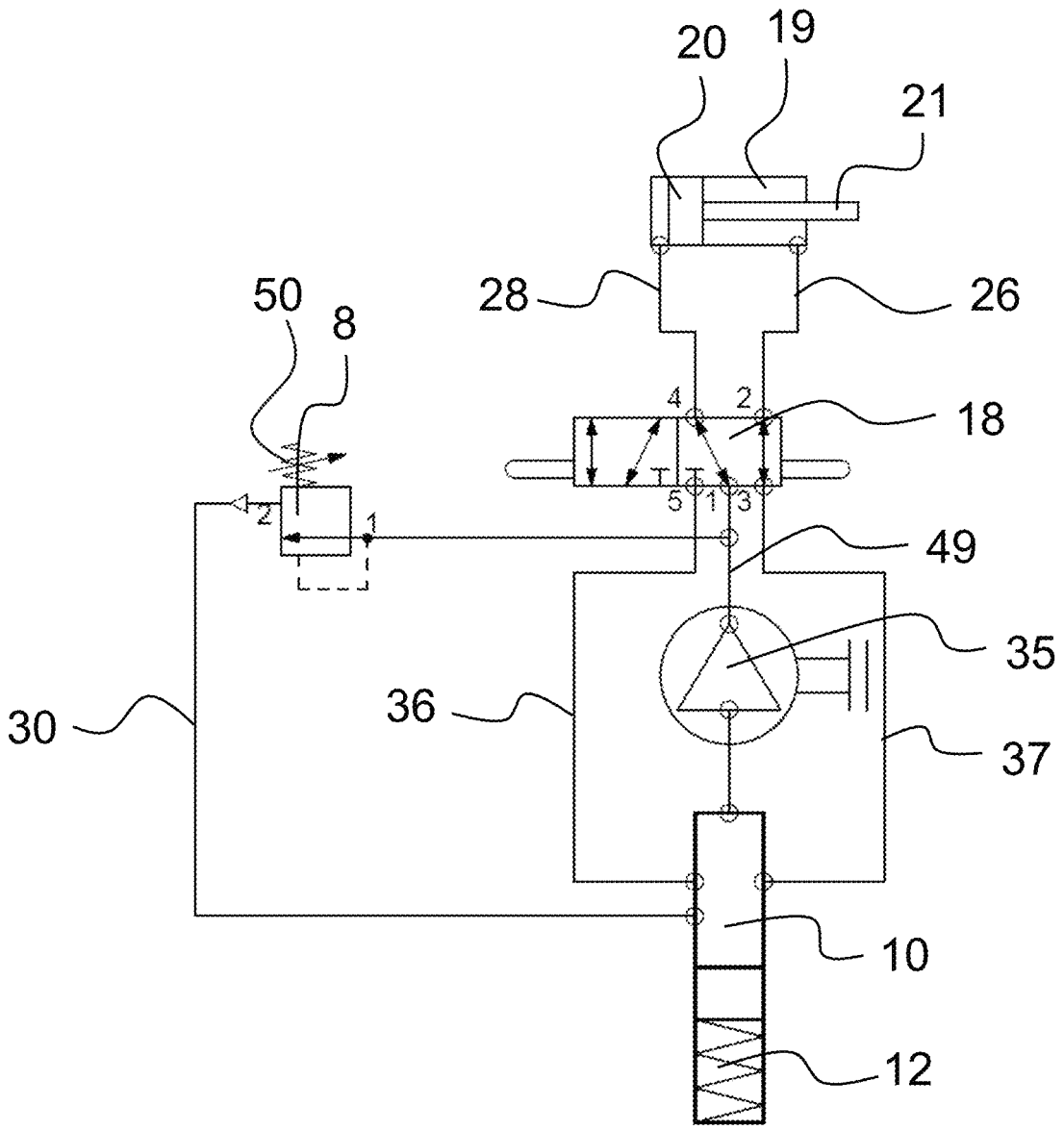
FIGS. 12 and 13 are hydraulic equivalent circuit diagrams intended for explaining in more detail two different embodiments of the disclosure.

FIG. 12 shows the hydraulic equivalent circuit diagram according to a first embodiment of the invention. The equivalent circuit diagrams of FIG. 12 and FIG. 13 can be applied to all of the illustrated embodiment variations.

In the embodiment according to FIG. 12, the control valve 18 is configured so as to remain in the respective advance or retract position for the power piston as set by the user.

In the position illustrated here, the control valve 18 is set such that the power piston 20 advances, i.e. moves forward when the hydraulic pump is operated.

Due to the piston rod 21 connected to the power piston 20, the power piston 20 is provided in the form of a differential piston. Thus, the front surface area of the piston is smaller than the rear surface area of the piston.

Consequently, when the power piston 20 is advanced by introducing hydraulic fluid through passage 28 and into the operating chamber 19, less hydraulic fluid will be displaced through passage 26 than is supplied through passage 28.

This differential can be compensated for by the hydraulic fluid accumulator 10 which is biased by spring 12.

In the embodiment illustrated here, the control valve 18 can be set to two switching states and will, as mentioned above, remain in the respective switching position even when the user releases the control valve 18 or an operator control coupled thereto.

In the position of the control valve 18 shown here, when the user does not operate the screwdriver, hydraulic fluid is able to flow through the hydraulic pump 35 which comprises the suction and pressure valves, inter alia. Thus, solely due of the pressure prevailing in the accumulator 10, hydraulic fluid will flow from the accumulator 10 through passage 49 and passage 28 and into the operating chamber 19 behind the power piston 20.

The power piston 20 is thereby advanced, even without operating the screwdriver. In this way, the tool attachment can be approached to the workpiece, for example.

The hydraulic fluid displaced from the operating chamber 19 in front of the power piston 20 flows through passage 26 and via control valve 18 and passage 37 into the accumulator 10.

When the user operates the screwdriver, the hydraulic pump 35 generates pressure and hydraulic fluid inflowing via passage 28 will drive the power piston 20 forward with such a strong force that for instance a riveting or punching process can be triggered.

In order to retract the power piston 20, in particular in order to process a blind rivet, for example, the user moves the control valve 18 into the other position in which the passage 49 is now connected to the passage 26 via the control valve 18.

When the screwdriver is not operated, the hydraulic pressure provided by the accumulator 10 continues to be applied to passage 28. For this purpose, the accumulator 10 is in communication with passage 28 via passage 36 through control valve 18 in this position. However, backflowing of the hydraulic fluid in front of the power piston 20 via passage 26 is blocked by the hydraulic pump 35, specifically by the suction and pressure valves (16 and 17 in FIG. 5) of hydraulic pump 35. Thus, with this retract position of the control valve 18, the power piston 20 will always remain in its position when the screwdriver is not operated.

If the user now operates the screwdriver and thus activates the hydraulic pump 35, fluid will be pressed through passage 26 into the operating chamber 19 in front of the power piston 20 by the hydraulic pump.

The power piston 20 will be retracted. Behind the power piston 20, the displaced hydraulic fluid can flow back into the accumulator 10 through passage 28 and passage 36.

Since the amount of displaced hydraulic fluid is now greater than the amount of introduced hydraulic fluid, the accumulator 10 which is biased by spring 12 will be charged during this retracting process.

The hydraulic equivalent circuit diagram furthermore shows the pressure control valve 8 which is connected between the discharge-side passage 49 of the hydraulic pump 35 on one side and the passage 30 to the accumulator 10.

Figure 12A:
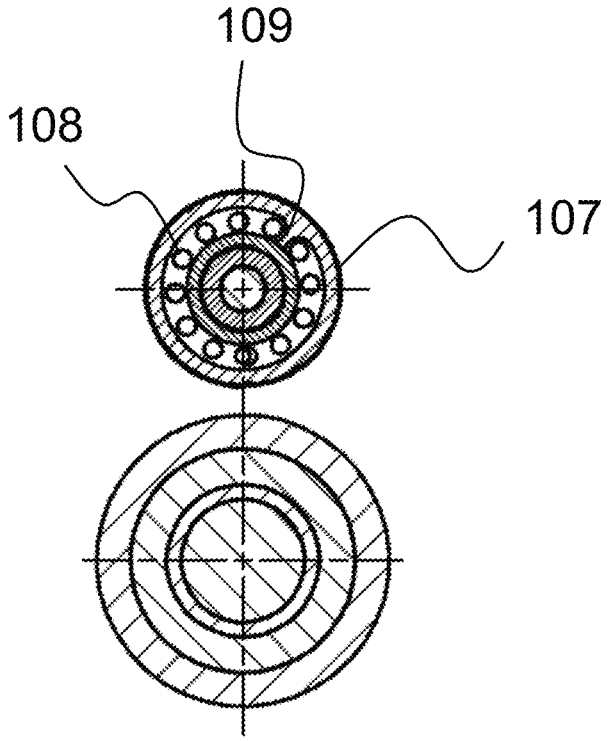
FIG. 12*a* is a sectional view taken along line J-J of FIG. 3.

Pressure control valve 8 is adjustable by control dial 107. So, the maximum operating pressure and hence the achievable operating force can be preset. Control dial 107 is coupled with a thread and allows for a rotary movement about preferably more than 180° and less than 360°, in the present exemplary embodiment about approximately 340°. Thereby, the spring of the valve piston is biased more or less, and the valve opens once a preset pressure is reached. This is illustrated in the sectional view of FIG. 12*a* which shows a section along line J-J in FIG. 3. The control dial 107 has detent bores 108, in particular with a respective offset of 30° therebetween. A spring-biased locking pin slides over these detent bores 108 so as to allow the operator to perceive the detent positions and hence the pressure levels that can be preset, which may additionally be marked on the outer surface of control dial 107. Stop 109 limits the rotary range of control dial 107.

As can be seen from FIG. 12, when the pressure control valve 8 is triggered, the hydraulic fluid escaping on the discharge side can flow back through passage 30 and into the accumulator 10, and in this way the hydraulic pump 35 is virtually short-circuited.

Since the pressure control valve 8 is designed as a full lift safety valve, as mentioned before, the pressure applied on passage 49 will abruptly fall to almost zero or to the pressure prevailing in the accumulator 10, and thus a setting or pulling process will be stopped.

Figure 13:
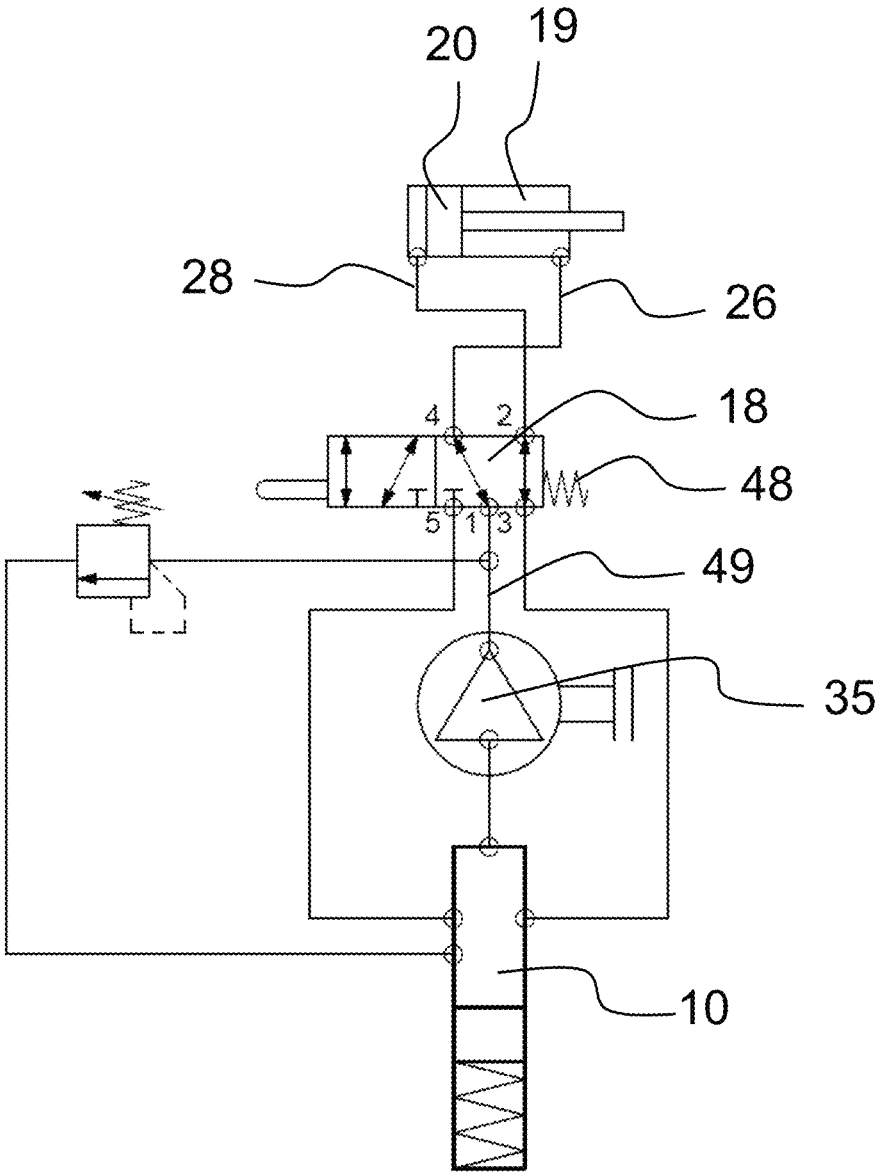

FIG. 13 is the hydraulic equivalent circuit diagram of an alternative embodiment of the invention in which two-hand operation is required to initiate a pressing process.

For this purpose, passages 26 and 28 are connected differently to the control valve.

In this embodiment, the control valve 18 is configured such that it has to be permanently actuated in order to be brought from the state shown here into the other switching position. For this purpose, control valve 18 is spring-biased by spring 48 in this exemplary embodiment.

In this non-actuated switching state, the pressure prevailing in the accumulator 10 is applied to both passage 26 and passage 28 in operating chamber 19 when the screwdriver is not operated. Since the hydraulic pump 35 blocks backflow through passage 26 in the non-operated state, the power piston 20 will always remain in its position.

When the user now operates the cordless screwdriver, the hydraulic pump 35 presses hydraulic fluid through control valve 18 and passage 26 and into the operating chamber 19 in front of the power piston 20 so that the latter is retracted, for example in order to place a blind rivet.

Thus, for retracting the user only needs to operate the screwdriver. It is not necessary to actuate the control valve 18 at the same time.

In order to trigger a pressing process, by contrast, the control valve 18 has to be permanently pressed into the other switching state, against the bias of the spring 48.

In this other switching state, the power piston 20 will move forward solely by virtue of the pressure prevailing in the hydraulic fluid accumulator 10.

Only when the control valve 18 is actuated, the hydraulic pump 35 will be able to feed hydraulic fluid via the discharge-side passage 49 and through passage 28 to behind the power piston 20. The power piston will be advanced to perform a pressing operation.

The hydraulic fluid displaced in front of the power piston 20 will flow back into the accumulator 10 via passage 26.

Figure 14:
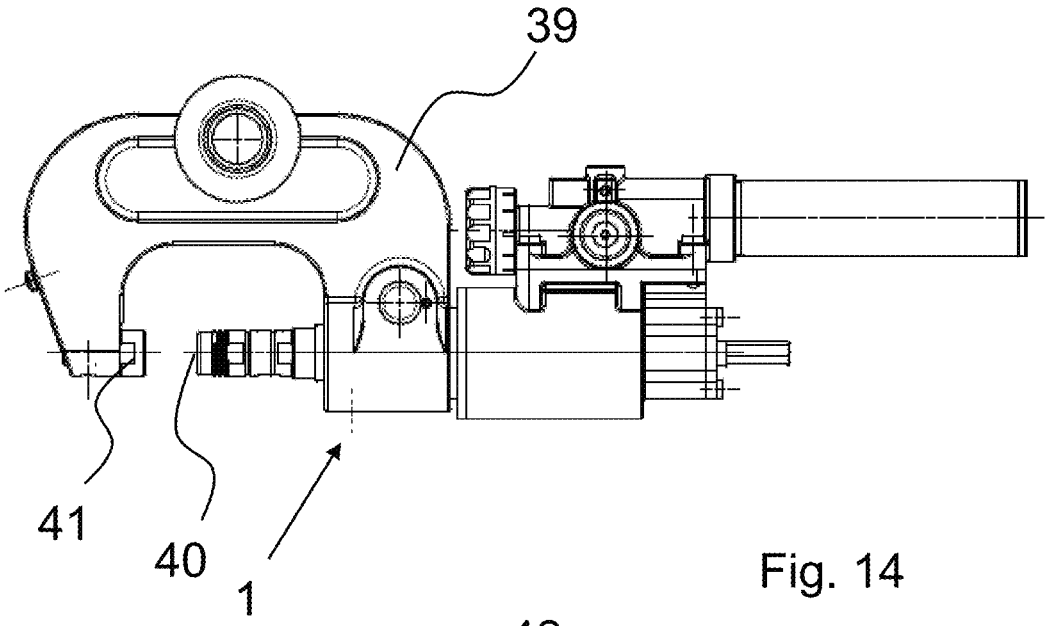
FIGS. 14 to 17 show the hydraulic tool with a riveting yoke as a tool attachment.

FIG. 14 is a side view of a hydraulic tool 1 (without screwdriver), the hydraulic tool 1 now comprising a riveting yoke 39 as a tool attachment.

Riveting yoke 39 is used to process two-piece rivets or punch rivets and comprises a setting punch 40 driven by the power piston and a die 41 opposite thereto.

Figure 15:
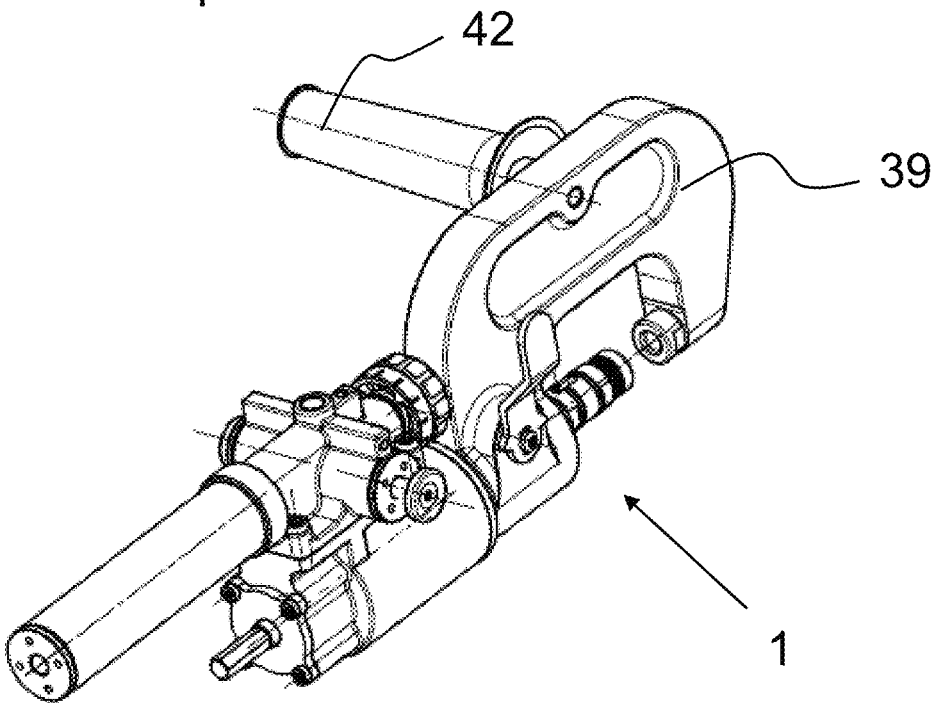

FIG. 15 is a perspective view of the hydraulic tool 1 shown in FIG. 14.

It can be seen that a handle 42 is mounted to the riveting yoke 39. Handle 42 may not only be used to hold the hydraulic tool 1. Rather, handle 42 can also serve as a torque support. So, the user can support the riveting yoke 39 against the torque of the screwdriver, without need to have the housing of the screwdriver coupled to the rest of the housing of the hydraulic tool. In this embodiment of the invention, the riveting yoke 39 and the housing of the hydraulic tool are preferably secured against rotation in the coupled state.

Figure 16:
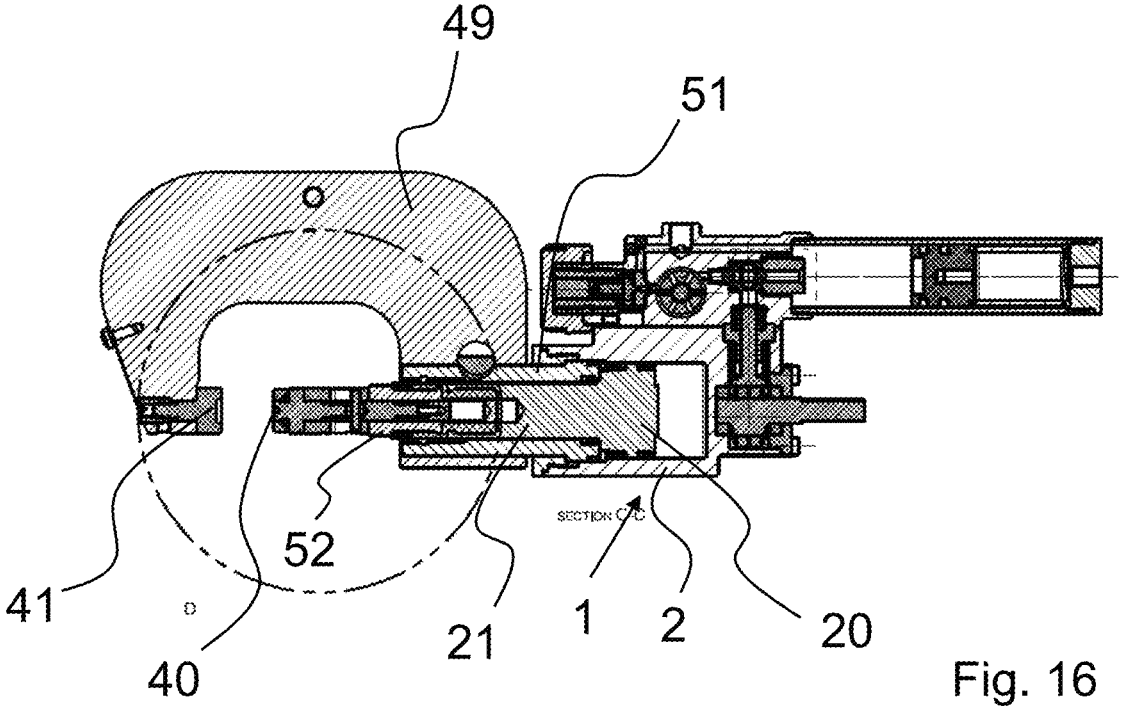

FIG. 16 is a sectional view of the hydraulic tool 1 shown in FIGS. 14 and 15.

What can be seen in particular here is the setting punch 40 and the die 41 opposite to one another.

The tool attachment in the form of riveting yoke 39 comprises a sleeve 51 which is coupled to the power piston housing 2. Sleeve 51 may in particular be screwed into the coupling 6.

Furthermore, riveting yoke 39 comprises an inner part 52 coupling the setting punch 40 to the piston rod 21 of power piston 20.

Setting punch 40 can thus be pushed forward by the power piston 20.

Figure 17:
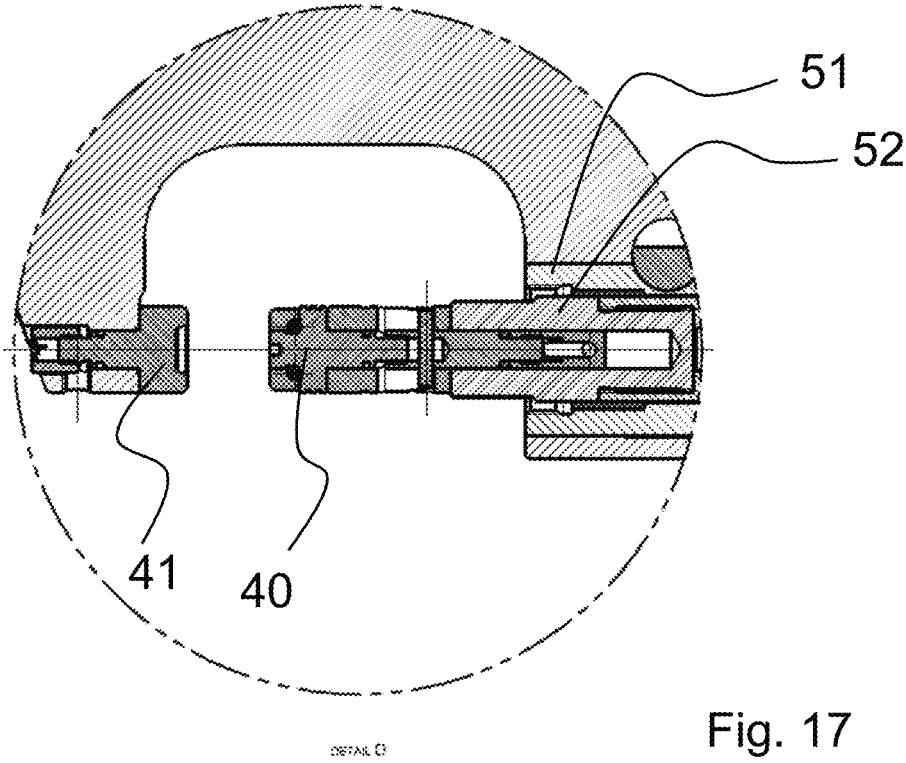

FIG. 17 is a detail view of the area D in FIG. 16. What can be seen here is the inner part 52 guided in sleeve 51, into which the setting punch 40 is inserted.

Figure 18:
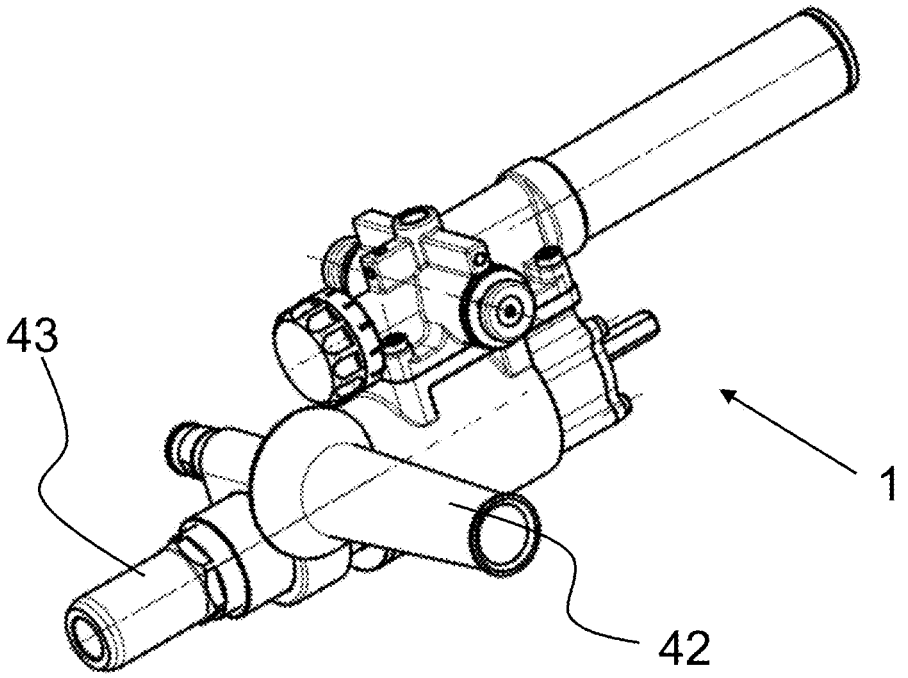
FIGS. 18 to 22 show the hydraulic tool with a pulling tool attachment, for example for setting blind rivets.

FIG. 18 shows how the hydraulic tool 1 comprises a pulling tool attachment 43 which is intended for setting blind rivets, for example.

Pulling tool attachment 43 also comprises a handle 42 which extends transversely to the main extension direction thereof.

Figure 19:
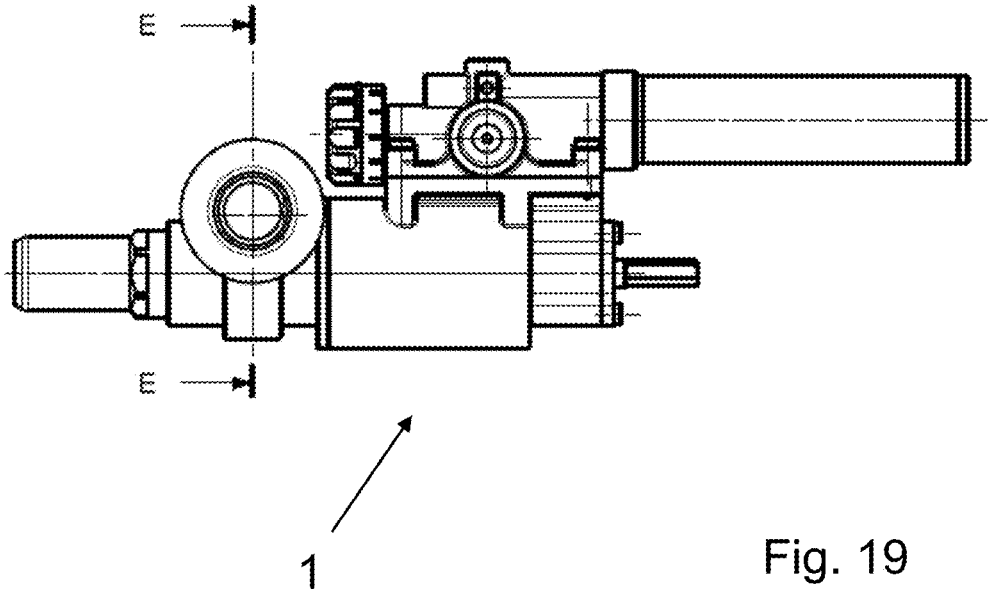

FIG. 19 is a side view of the hydraulic tool 1 shown in FIG. 18.

Figure 20:
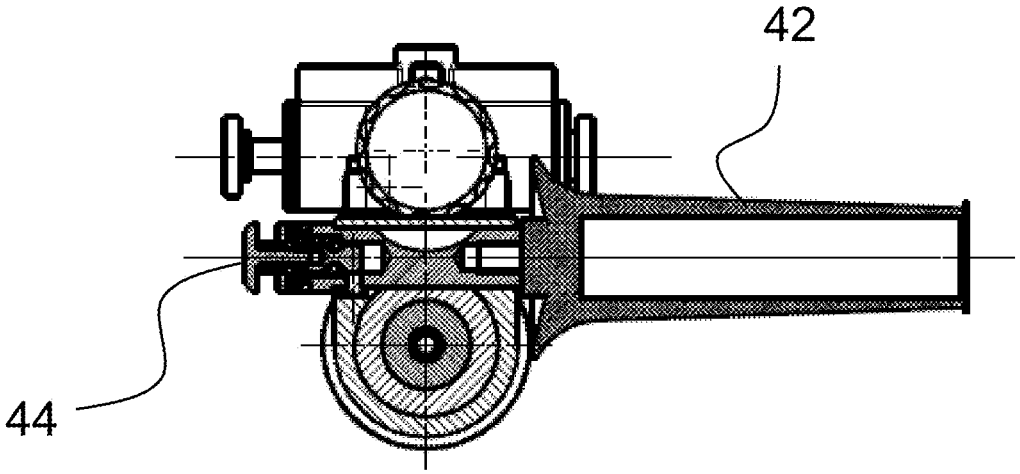

FIG. 20 is a sectional view taken along line E-E in FIG. 19.

Thus the section is cut through the handle 42.

It can be seen that the handle 42 can be released through a release member 44, without tools.

Figure 21:
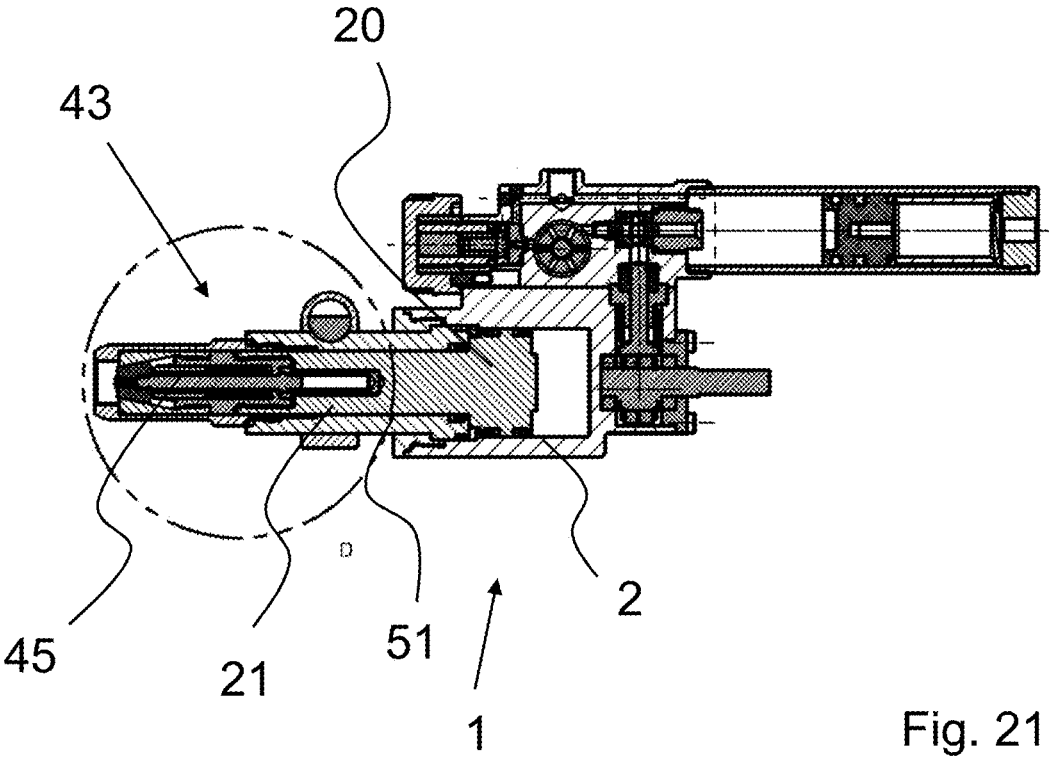

FIG. 21 is a sectional view of the hydraulic tool 1 shown in FIGS. 18 and 19 taken along the main extension direction thereof. Pulling tool attachment 43 comprises the sleeve 51 which is coupled to the power piston housing 2.

Power piston 20 is coupled to the pulling device 45 through piston rod 21.

Figure 22:
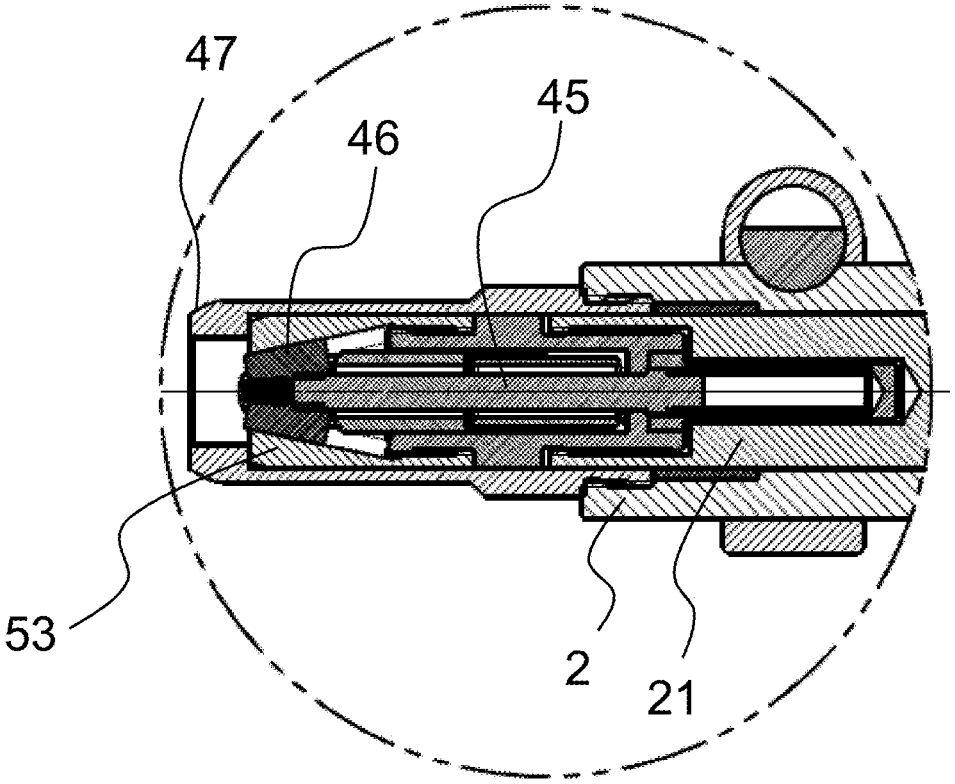

FIG. 22 is a detail view of the area D in FIG. 21.

In particular the pulling device 45 is shown in this detailed illustration.

It can be seen that pulling device 45 comprises claws 46.

In the state shown here in which the power piston is in its forward or extended position, claws 46 are open.

The user can now insert a blind rivet into the pulling device 45.

When processing the blind rivet, the pulling device 45 bears against the workpiece with its front sleeve 47, in known manner.

During retraction, the claws 46 are contracted by ramps 53 and retain the break-off mandrel of the blind rivet captured until it breaks off at the end of the setting process.

Figure 23:
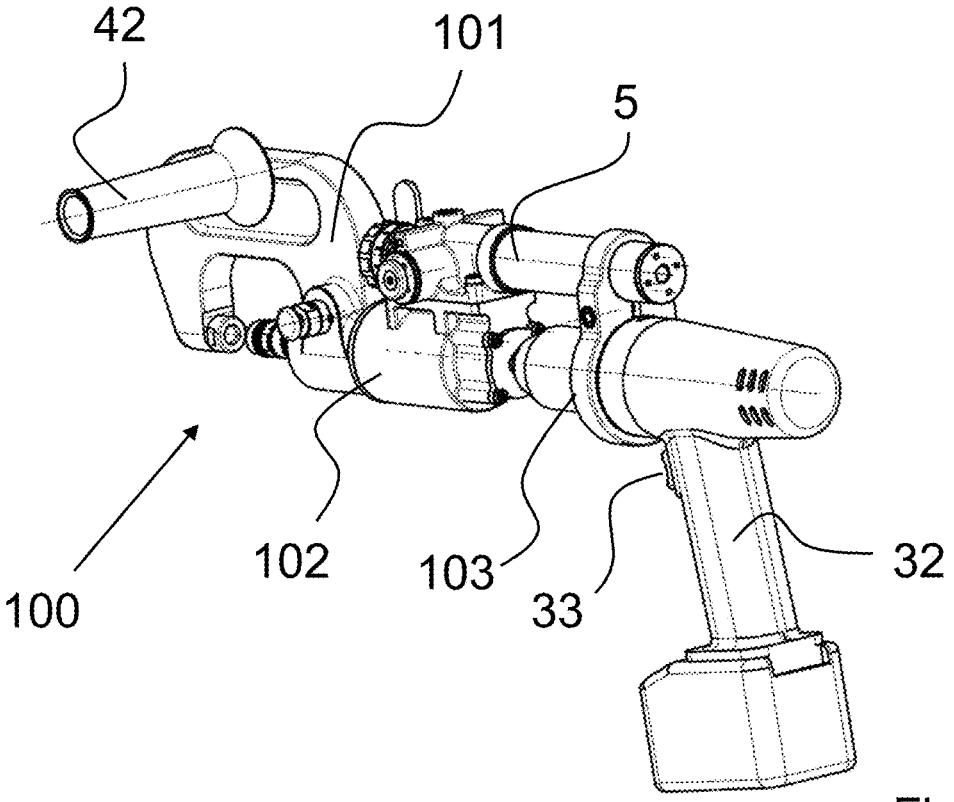
FIGS. 23 and 24 show an embodiment of a tool with a pulling or pressing device, comprising a torque support which can be coupled to the setting collar for the maximum torque of a cordless screwdriver.

FIG. 23 is a perspective view of a tool 100 comprising a pulling and/or pressing device that can be coupled with a screwdriver, here a cordless screwdriver 32.

In this exemplary embodiment, the tool 100 is a hydraulic tool according to the exemplary embodiments described above. However, the tool 100 may also work according to another principle in this embodiment of the invention.

The tool 100 comprises a housing 102 with a pulling and/or pressing device which is connected to the cordless screwdriver 32 through a drive shaft.

The tool attachment 101 is rotatably connected to the housing 102. In this exemplary embodiment, the tool attachment 101 is designed as a riveting yoke and comprises the handle 42. It goes without saying that the tool attachment 101 may alternatively correspond to the pulling tool attachment described above.

In order to set a rivet, the tool 101 is driven by actuating the operating button 33 of the cordless screwdriver 32.

The housing 102 of tool 100 is connected to the cordless screwdriver 32 through torque support 103.

In this exemplary embodiment, the torque support 103 is fitted around the hydraulic fluid accumulator housing 5.

Figure 24:
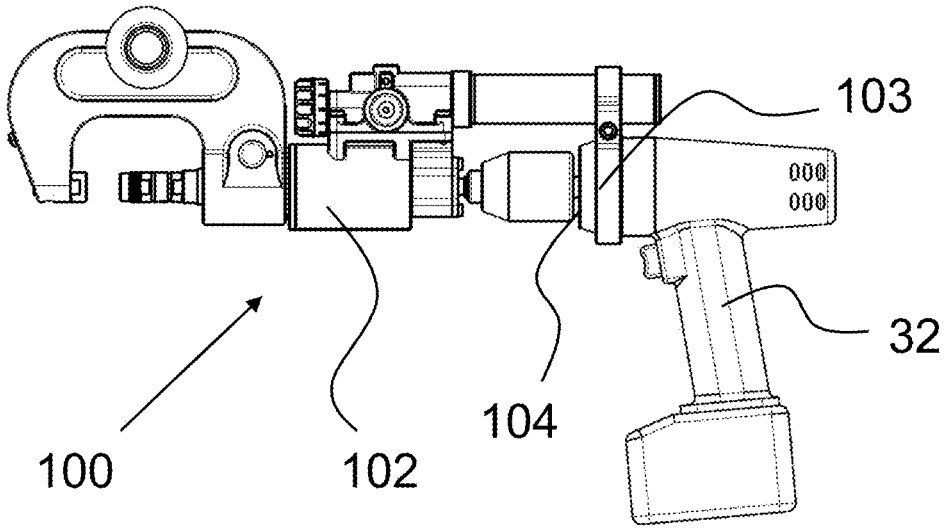

As can be seen in the side view of FIG. 24, the torque support 103 engages around the torque limit setting collar 104 of the cordless screwdriver 32.

If now a rivet is set, the housing 102 is initially held by the tool attachment 101 which is rotatably coupled to the housing 102. The torque between tool attachment 101 and housing 102, at which rotation between these two components starts to occur can be adjusted, for example using sealing elements such as O-rings.

If now the torque increases, for example towards the end of a setting process, the housing 102 will rotate relative to the tool attachment 101 and thus also relative to the cordless screwdriver 32.

In response thereto, the torque support 103 which engages around the setting collar 104 will cause the torque clutch 103 of the cordless screwdriver 32 to open and the pulling and/or pressing process will be stopped.

Figure 25:
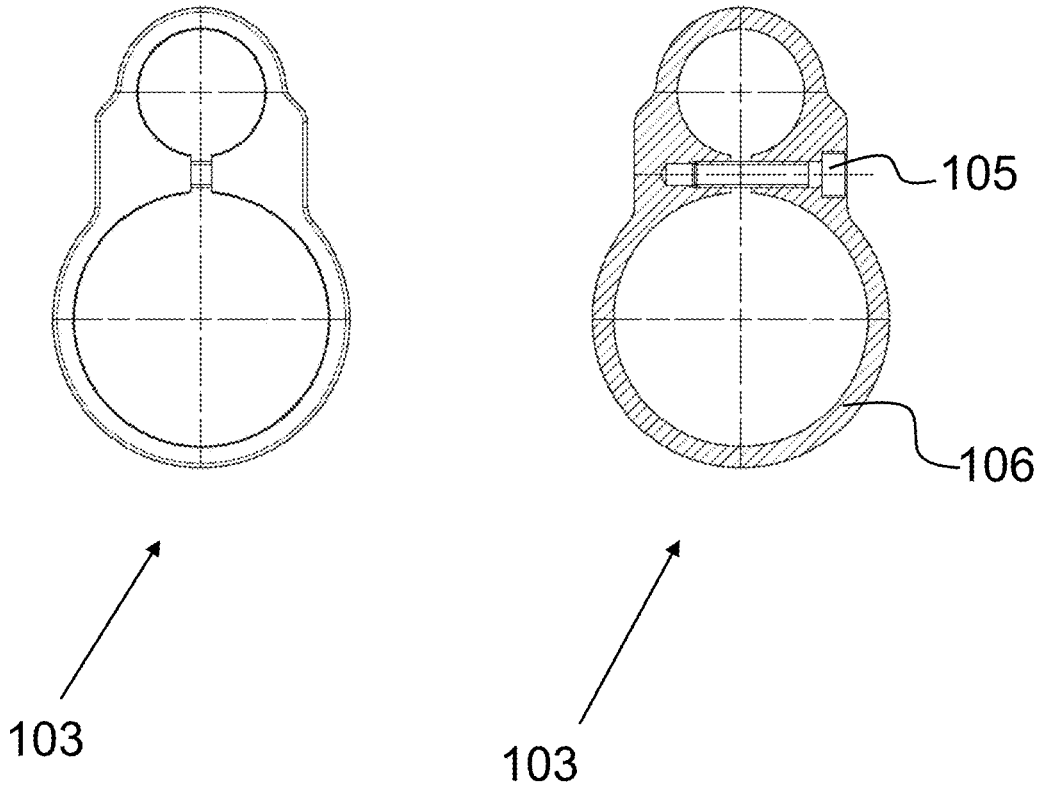
FIG. 25 shows the torque support in a plan view and in a sectional view.

FIG. 25 shows the torque support 103 in a plan view and in a sectional view side by side.

In this exemplary embodiment, clamping screw 105 serves to connect the torque support 103 both to the housing of the tool (102 in FIGS. 23/24) and to the setting collar (104) of the cordless screwdriver (32).

The coupling ring 106 for the setting collar is preferably adjustable in its diameter and/or consists of elastic material, at least in sections thereof, to adapt to different cordless screwdrivers.

Figure 26:
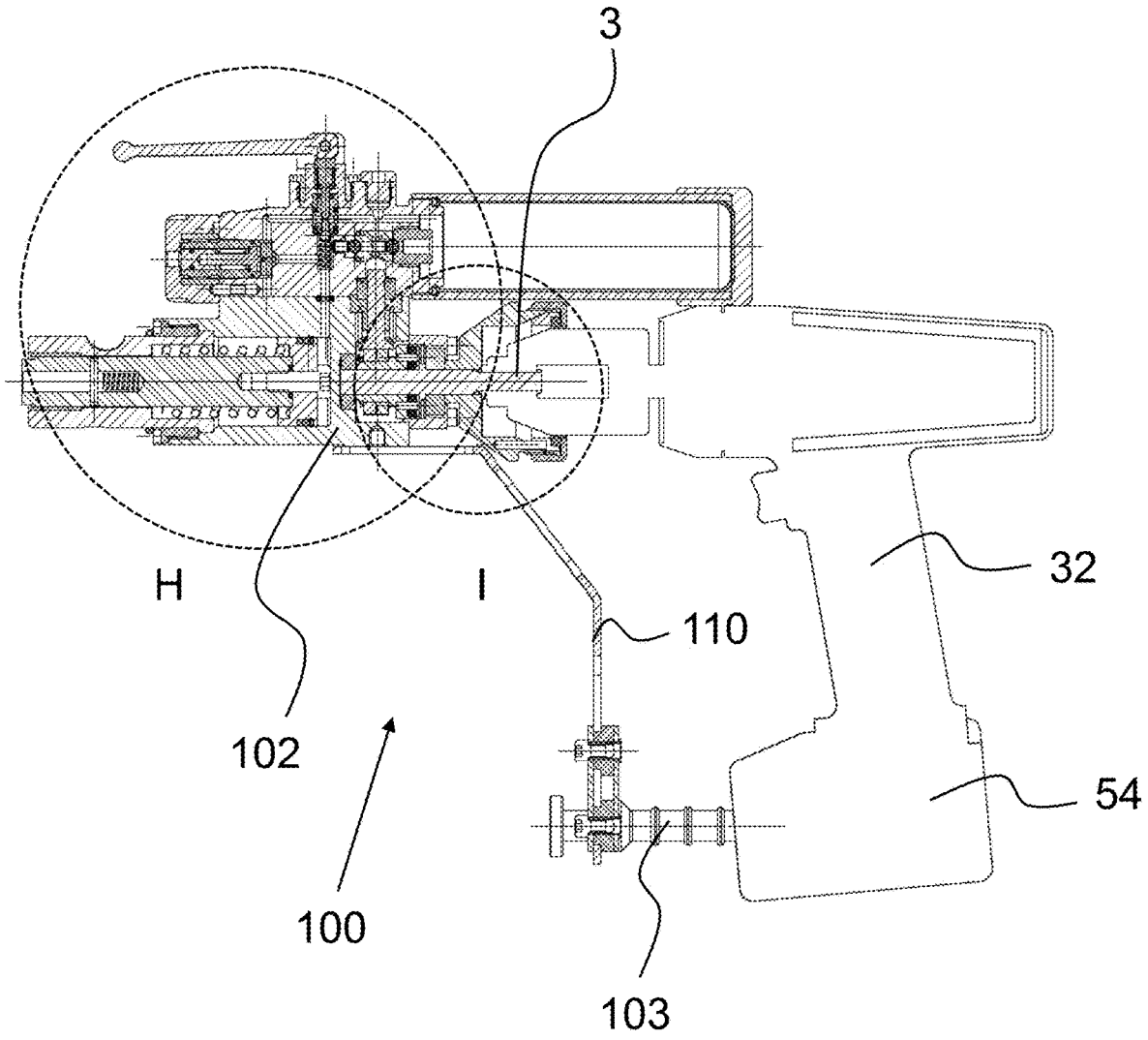
FIGS. 26 to 28 show a further embodiment of a tool according to the invention comprising a pulling or pressing device.
Figure 27:
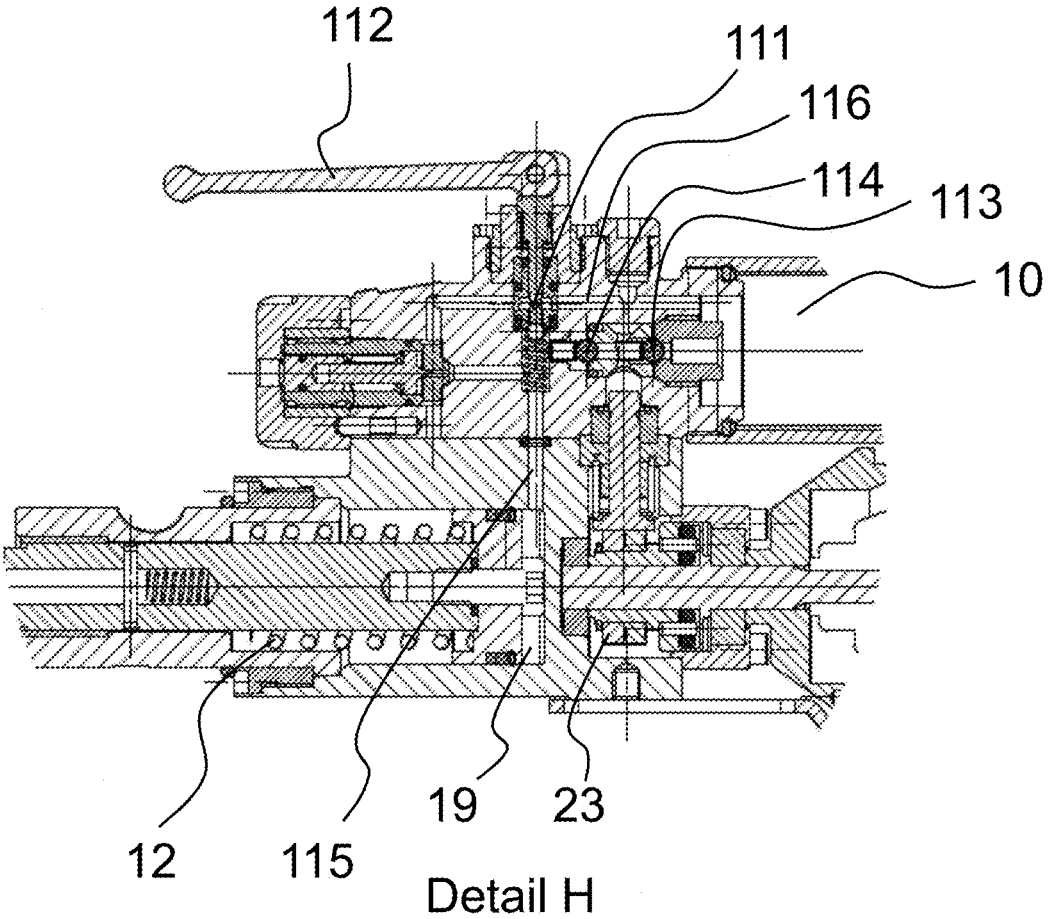
Figure 28:
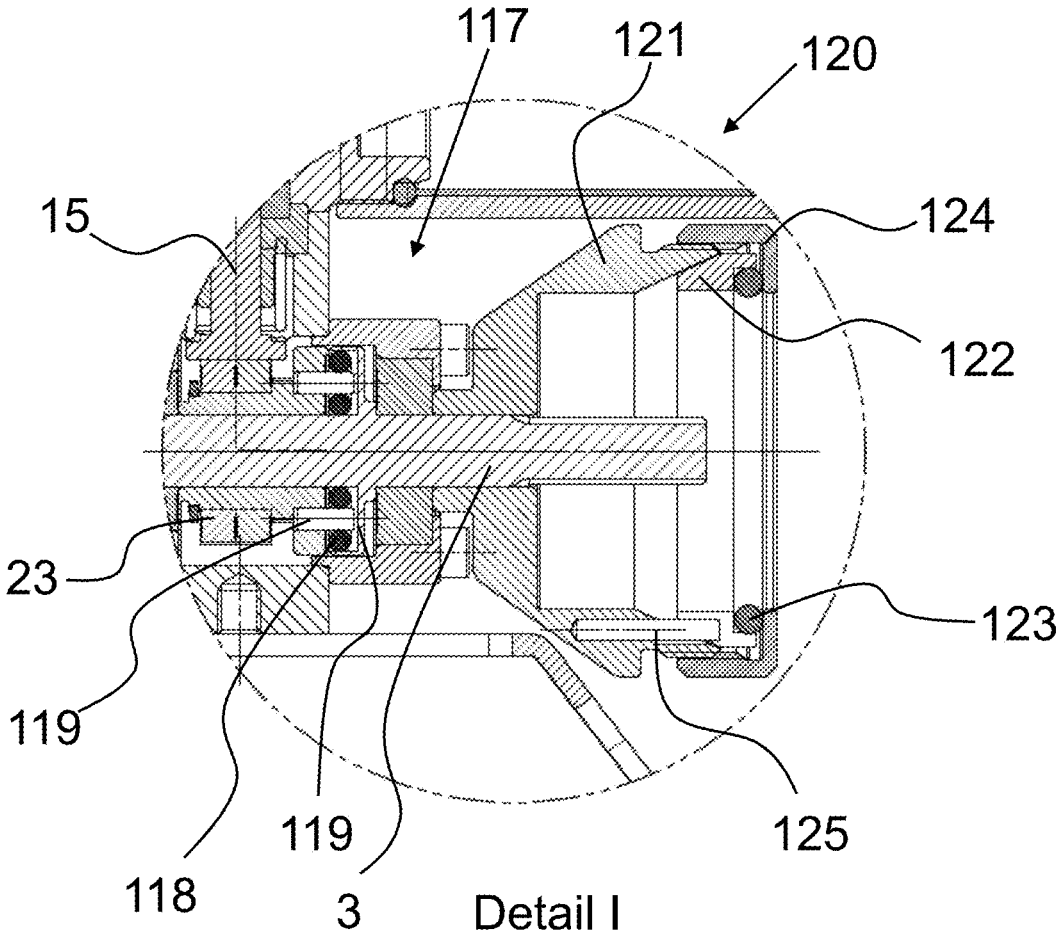

FIGS. 26 to 28 are views of a further alternative embodiment of a tool 100 comprising a pulling or pressing device.

The tool shown in these drawings substantially corresponds to the exemplary embodiment illustrated in FIGS. 1 through 22, so that primarily the structural differences will be explained below.

FIG. 26 is a sectional view of the tool 100 with a pulling or pressing device.

A housing 102 comprising a hydraulic pump is coupled to a cordless screwdriver 32 through a drive shaft 3.

In contrast to the previously illustrated exemplary embodiments, the torque support 103 engages on the foot 54 of the cordless screwdriver 32 through an arm 110 which is connected to the housing 102. In this way, a longer lever can be provided for support in comparison with the previously described exemplary embodiments.

The width and/or height of the torque support 103 which engages around the foot 54 in a clamp-like manner is preferably adjustable in order to adapt to differently shaped cordless screwdrivers 32.

FIG. 27 is a detail view of the area H in FIG. 26, showing the configuration of the hydraulic pump.

In contrast to the exemplary embodiment illustrated before, the hydraulic pump does not comprise a control valve through which the power piston can be advanced and retracted, but only comprises a relief valve 111 which is a 2/2-way valve in this exemplary embodiment.

When the cordless screwdriver is operated, the driven cam shaft 23 causes hydraulic fluid to be pumped via suction valve 113 and pressure valve 114 from the accumulator 10 through passage 115 and into the operating chamber 19 of the pulling or pressing device.

Once a pulling or pressing process has been completed, the user can actuate the relief valve 111 through an actuation means 112 which may be in the form of a lever, for example.

In this exemplary embodiment, a spring-biased ball opens the relief valve 111 and hydraulic fluid can flow back into the accumulator 10 via passage 115, through relief valve 111, and through passage 116.

The pressure required for this is provided by a spring 12, which resets the power piston of the pulling or pressing device.

FIG. 28 is a detail view of the area I in FIG. 26, which shows the coupling between the screwdriver and the rest of the hydraulic tool.

On the one hand, the cam shaft 23 of pump piston 15 is coupled to the drive shaft 3 via an elastic coupling 117.

Elastic coupling 117 is integrated in the housing and consists of a coupling bell 119 which is connected to the cam shaft 23 through at least one ring 118 made of elastic material.

In this exemplary embodiment, the connection is made by pins 119.

The soft coupling created in this way allows to largely avoid rattling as is in particular caused by the drive shaft recoiling when the pump piston 15 exceeds a dead center.

Furthermore, the drive shaft is provided with a chuck lock 120 which can be used to fix the chuck of the cordless screwdriver (not shown) in order to prevent it from loosening due to vibrations.

The chuck lock 120 comprises a bell 121 which at the same time serves as a flywheel for the drive shaft 3.

A union nut 124 engages around the bell and serves to tighten the chuck lock 120.

In this exemplary embodiment, in order to provide a non-positive connection, the chuck lock 120 comprises a deformable ring 122 which is slotted, for example, and can thus be reduced in diameter when being pressed against an inclined surface by tightening the union nut 124.

In this exemplary embodiment, the deformable ring 122 is secured against rotation relative to the bell 121 by a pin 125.

Furthermore, in this exemplary embodiment, a ring 123 made of elastic material such as an O ring is inserted into the deformable ring 122 in order to improve adhesion to the chuck of the screwdriver.

In order to improve the connection between the drive shaft 3 and the cordless screwdriver, the drive shaft 3 may have positive locking features (not shown) which engage in the chuck of the cordless screwdriver.

LIST OF REFERENCE NUMERALS

1 Hydraulic tool
2 Power piston housing
3 Drive shaft
4 Hydraulic pump housing
5 Accumulator housing
6 Coupling
7 Operator control
7*a*, 7*b* Actuation means
8 Pressure control valve
9 Rod
10 Hydraulic fluid accumulator
11 Piston
12 Spring
13 Passage
14 Cam drive
15 Pump piston
16 Suction valve
17 Pressure valve
18 Control valve
19 Operating chamber
20 Power piston
21 Piston rod
22 Passage
23 Cam shaft
24 Ball bearing
25 Accumulation passage
26 Passage
27 Passage
28 Passage
29 Valve body
30 Passage
31 Passage
32 Cordless screwdriver
33 Operation button
34 Chuck
35 Hydraulic pump
36 Passage
37 Passage
38 Setting means
39 Riveting yoke
40 Setting punch
41 Die
42 Handle
43 Pulling tool attachment
44 Release means
45 Pulling device
46 Claws
47 Sleeve
48 Spring
49 Passage
50 Spring
51 Sleeve
52 Inner part
53 Ramp
54 Foot of screwdriver
100 Tool with pulling and/or pressing device
101 Tool attachment
102 Housing
103 Torque support
104 Setting collar

105 Clamping screw
106 Coupling ring
107 Control dial
108 Detent bore
109 Stop
110 Arm
111 Relief valve
112 Actuation means
113 Suction valve
114 Pressure valve
115 Passage
116 Passage
117 Elastic coupling
118 Ring made of elastic material
119 Coupling bell
120 Chuck lock
121 Bell/flywheel
122 Deformable ring
123 Ring made of elastic material
124 Union nut
125 Pin

The invention claimed is:

1. A hydraulic tool for driving a pulling or pressing device, comprising:

a hydraulic pump that pumps hydraulic fluid into an operating chamber of a hydraulic power piston;

a drive shaft configured to be mounted to a screwdriver and operable to drive the hydraulic pump; and a torque support which is supported on a housing of the screwdriver.

2. The hydraulic tool as in claim 1, wherein the hydraulic pump comprises a pump piston, the pump piston being driven by the drive shaft to reciprocate and pump the hydraulic fluid into the operating chamber of the hydraulic power piston.

3. The hydraulic tool as in claim 2, further comprising a cam that drives the pump piston to reciprocate.

4. The hydraulic tool as in claim 1, wherein the power piston is connected to a coupling for a setting tool or pressing tool attachment.

5. The hydraulic tool as in claim 1, further comprising a hydraulic fluid accumulator which serves as a buffer volume during movement of the power piston.

6. The hydraulic tool as in claim 5, wherein the hydraulic fluid accumulator is arranged behind the power piston and laterally offset from the drive shaft.

7. The hydraulic tool as in claim 6, wherein the accumulator is pressurized by a spring that engages a piston such that in a non-operated state of the hydraulic tool the power piston moves into an end position.

8. The hydraulic tool as in claim 5, further comprising a pressure control valve which allows hydraulic fluid to flow back into the hydraulic fluid accumulator once a predetermined maximum pressure is exceeded.

9. The hydraulic tool as in claim 5, wherein the torque support is mounted to a housing of the hydraulic fluid accumulator.

10. The hydraulic tool as in claim 1, further comprising an operator control that is actuable to feed hydraulic fluid into an operating chamber of the power piston either in front of or behind the power piston.

11. The hydraulic tool as in claim 10, wherein the operator control is coupled to a 5/2-way valve.

12. The hydraulic tool as in claim 10, wherein the operator control is coupled to a control valve and configured such that the control valve has to be actuated permanently in order to advance the power piston.

13. The hydraulic tool as claimed in claim 12, wherein the control valve comprises a rod extending transversely to the power piston, and which serves to open and close passages extending along the rod.

14. The hydraulic tool as in claim 1, wherein the power piston is aligned parallel to the drive shaft.

15. The hydraulic tool as in claim 1, wherein the hydraulic tool is coupled to a screwdriver.

16. The hydraulic tool as in claim 1, wherein an elastic coupling is arranged between the drive shaft and the hydraulic pump.

17. The hydraulic tool as in claim 1, further comprising a chuck lock for the screwdriver.

18. The hydraulic tool as in claim 1, further comprising a drive shaft with a flywheel.

* * * * *